US008113971B2

(12) United States Patent
Underwood

(10) Patent No.: US 8,113,971 B2
(45) **Date of Patent: *Feb. 14, 2012**

(54) MULTI-MATERIAL COMPOSITE LOCKING UPRIGHT

(75) Inventor: Bradford J. Underwood, Columbus, OH (US)

(73) Assignee: Sports Imports, Inc., Columbus, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,166

(22) Filed: May 24, 2011

(65) Prior Publication Data

US 2011/0224031 A1 Sep. 15, 2011

Related U.S. Application Data

(63) Continuation-in-part of application No. 12/481,065, filed on Jun. 9, 2009, now Pat. No. 7,972,226, which is a continuation of application No. 12/167,571, filed on Jul. 3, 2008, now Pat. No. 7,559,860, which is a continuation-in-part of application No. 11/436,687, filed on May 18, 2006, now Pat. No. 7,410,431.

(51) Int. Cl.
*A63B 61/02* (2006.01)

(52) U.S. Cl. ..... 473/492

(58) Field of Classification Search ..... 473/490, 473/493, 492

See application file for complete search history.

(56) References Cited

U.S. PATENT DOCUMENTS

| | | | |
|---|---|---|---|
| 834,999 | A | 11/1906 | Schutz |
| 942,761 | A | 12/1909 | Voynow |
| 1,459,723 | A | 6/1923 | Eskell |
| 1,668,020 | A | 5/1928 | Marquardt |
| 3,350,822 | A | 11/1967 | Nachazel |
| 3,931,965 | A | 1/1976 | Grant |
| 4,040,214 | A | 8/1977 | Frye |
| 4,065,099 | A | 12/1977 | Germain |
| 4,071,996 | A | 2/1978 | Muto et al. |
| 4,122,451 | A | 10/1978 | Senoh |
| 4,197,827 | A | 4/1980 | Smith |
| 4,253,671 | A | 3/1981 | Pace |
| 4,281,487 | A | 8/1981 | Koller |
| 4,444,397 | A | 4/1984 | Kaburagi et al. |
| 4,615,278 | A | 10/1986 | Cabrelli |
| 4,684,230 | A | 8/1987 | Smith |
| 4,844,455 | A | 7/1989 | Funkhouser, Jr. |
| 4,987,718 | A | 1/1991 | Knight |
| 5,215,310 | A | 6/1993 | Allbright |
| 5,242,174 | A | 9/1993 | Koole |
| 5,308,085 | A | 5/1994 | Koole |

(Continued)

*Primary Examiner* — Raleigh W. Chiu
(74) *Attorney, Agent, or Firm* — Michael J. Gallagher; David J. Dawsey; Gallagher & Dawsey Co., LPA

(57) ABSTRACT

A composite locking upright having low weight and great rigidity for installation into a playing surface with built-in sleeves, supporting and securing a net at a playing height for athletic sports such as, volleyball, tennis, and badminton. The composite locking upright may have a composite tube, a multi-material tube, an upper protective collar, and in some embodiments a lower protective collar, and a locking tool. The composite tube may be made of a light-weight, fiber-reinforced composite. The multi-material tube may be made at least in part of the same material and may incorporate at least one abrasion resistant area, which may be a partial or full thickness insert which may be formed of a metal. The multi-material tube is extendable and retractable from the composite. The locking tool locks the multi-material tube with respect to the composite tube and thereby fixes a net at a playing height.

20 Claims, 19 Drawing Sheets

U.S. PATENT DOCUMENTS

| | | | |
|---|---|---|---|
| 5,358,257 | A | 10/1994 | Pardi |
| 5,371,986 | A | 12/1994 | Guditis |
| 5,542,679 | A | 8/1996 | Caso |
| 5,855,527 | A | 1/1999 | Koole |
| 5,860,877 | A | 1/1999 | Esser |
| 6,030,301 | A | 2/2000 | Asada et al. |
| 6,089,995 | A | 7/2000 | Schroeder |
| 6,575,434 | B2 | 6/2003 | Bligh et al. |
| 6,694,698 | B2 | 2/2004 | Ryan |
| 6,755,005 | B2 | 6/2004 | Czachor et al. |
| 6,800,043 | B1 | 10/2004 | Pohrer |
| 6,852,046 | B1 | 2/2005 | Wewel et al. |
| 7,410,431 | B2 | 8/2008 | Underwood |
| 7,559,860 | B2 | 7/2009 | Underwood |
| 2002/0065153 | A1 | 5/2002 | Bertrand |
| 2006/0073922 | A1 | 4/2006 | Stambaugh |
| 2009/0247330 | A1 | 10/2009 | Underwood |

MULTI-MATERIAL COMPOSITE LOCKING UPRIGHT

CROSS-REFERENCE TO RELATED DOCUMENTS

This application is a continuation-is-part of a previous application filed in the United States Patent and Trademark Office on Jun. 9, 2009 now U.S. Pat. No. 7,972,226, titled "Multi-Material Composite Locking Upright," and given application Ser. No. 12/481,065, which is a continuation of a previous application filed in the United States Patent and Trademark Office on Jul. 3, 2008 now U.S. Pat. No. 7,559,860, titled "Multi-Material Composite Locking Upright," and given application Ser. No. 12/167,571, which is a continuation-in-part of application Ser. No. 11/436,687, filed on May 18, 2006, now U.S. Pat. No. 7,410,431; the contents of which are incorporated by reference as if completely written herein.

TECHNICAL FIELD

The instant invention relates to uprights for supporting and securing a net for playing volleyball, tennis, badminton, and other sports, and, more particularly, to a composite locking upright having a composite tube with at least one protective collar, a multi-material tube, and a locking tool all designed to maximize the rigidity and durability, while minimizing the weight, of the upright.

BACKGROUND OF THE INVENTION

Uprights are used to hold a net in position for athletic or recreational sporting activities, such as volleyball, tennis, and badminton. Many sporting facilities are constructed with a court or a playing surface that is multifunctional. For instance, the playing surface may, on occasion, be a basketball court, at other times the court may be setup for badminton, tennis, or volleyball.

To support a multifunctional role, the playing surface may have a plurality of sleeves or recesses installed in the playing surface. One end of the upright is typically inserted into the sleeve. The sleeves permit the upright to be installed and removed, allowing the playing surface to be converted from facilitating one sport to another sport. For badminton, tennis, and volleyball, two uprights are generally required to provide support for the net to be strung tautly between the uprights.

Most sporting regulations require that the net be taut between the uprights. By pulling the net taut, the load on the upright increases, causing the upright to flex in the direction of the net. In most regulation sports, only minimal flexing of the upright is permitted. As the upright length increases it must be more resistant to flexing. In other words, the upright must be more rigid. This is particularly true for volleyball.

In use, in addition to holding the net in position, the uprights must be able to withstand impact of a ball on the net, and the impact of one or more players into the net or pole. The latter of the two impacts can amount to significant forces on the upright due to the momentous forces produced by a moving body.

Some uprights have telescopic designs. Two tubes, one having a smaller diameter, are constructed so that one extends from and slides within another. Once the desired net playing height is set, the two tubes are locked into position relative to each other. Telescoping adjustable height uprights serve different classifications of players. For example, a youth league may require a lower net playing height than an adult league, which may have different net playing heights for women than for men. This telescoping design permits adjustment of the net to meet the net playing height requirements for multiple leagues of varying skill levels.

In addition to having flexible height settings, the upright should be easy to handle for setup and removal. The weight of the upright may influence the ease with which the upright is installed and removed from the sleeve. Obviously, as the upright weight increases, handling the upright during installation and removal becomes increasingly more difficult and, possibly dangerous. Not only is bodily injury an issue for heavy uprights, damage to the playing surface may also occur. Therefore, light uprights are more desirable because they are easier and safer to install and remove. Unfortunately, light uprights generally lack the durability and rigidity desired, that is, light uprights flex more and are more likely to fail under reasonable playing conditions.

Like with other sporting goods, advanced materials have allowed some reconciliation between the competing design requirements. Composites are one type of advanced material. Composites offer the advantage of having lower weight with greater rigidity, making them an attractive alternative to multi-material components. Fiber reinforced composites consist of a plurality of fibers of one material that are bound in a matrix of resin or another organic material. The reinforcing fibers tend improve the rigidity of the matrix while the matrix distributes the load among the fibers. One of the drawbacks with fiber reinforced composites is that many of the fibers found in composites are susceptible to flaws or defects on their surfaces. These defects may cause the composite to fail or fracture when placed under a load. Moreover, composites are less durable than their multi-material counterparts mainly due to defects caused by abrasion. In the case of the upright, abrasion from installation, setup, and removal, may cause a reduction in the rigidity and strength of the composite.

There remains an unfulfilled need for a composite locking upright that is light in weight but does not sacrifice durability and useable life to attain its light weight. Additionally, there remains an unfulfilled need to provide a composite locking upright which is rigid while being cost effective.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is a composite locking upright for installation into a playing surface having a plurality of built-in sleeves. By way of example and not limitation, the playing surface may be used for indoor volleyball, badminton, and tennis, in addition to basketball or other sports not requiring uprights. In an embodiment of the instant invention the composite locking upright supports a net at a net playing height by supporting, and securing, a plurality of ropes so that, by way of example and not limitation, volleyball, badminton, and tennis may be played.

In one embodiment, the composite locking upright has a composite tube, an upper protective collar, a lower protective collar, a multi-material tube, and a locking tool. The composite tube may be made of a fiber reinforced organic matrix. The multi-material tube may be made at least in part of a fiber reinforced organic matrix and may incorporate at least one abrasion resistant area.

In one embodiment, the composite tube has a composite tube interior surface, a composite tube exterior surface, a sleeve support end, and a receiving end. The upper protective collar has an upper collar attachment surface, a bearing surface, an upper collar exterior surface, and a guard surface. The upper protective collar is attached at the receiving end of the composite tube. The guard surface and the upper collar exterior surface substantially prevent damage to the receiving end of the composite tube. In one embodiment, the upper protective collar may have at least one locking tool receiver for cooperating with the locking tool.

In one embodiment, the lower protective collar has a lower collar attachment surface, a sleeve contact surface, a support end, and a reinforcement end. The lower protective collar may be attached at the sleeve support end of the composite tube. The lower protective collar cooperates with the built-in sleeve which may allow the upright to be installed and removed from the built-in sleeve without substantially damaging the composite tube.

The multi-material tube extends from the receiving end of the composite tube. In one embodiment, the multi-material tube may have a multi-material tube interior surface, a multi-material tube exterior surface, an insertion end, and a rope contact end. The multi-material tube exterior surface may be formed with a plurality of net height receiving fixtures. The multi-material tube telescopes in and out of the composite tube and may cooperate with the upper protective collar. In order to protect the composite tube from contact with the multi-material tube, as it slides longitudinally within the composite tube, the multi-material tube exterior surface may slide against the bearing surface of the upper protective collar. In another embodiment of the instant invention, the multi-material tube has a pulley wheel rotatably attached to the rope contact end.

The various positions of the multi-material tube relative to the composite tube may be locked by the locking tool operating in conjunction with the locking tool receiver and the net height receiving fixtures. Thus, when the rope is threaded onto the rope contact end, the net playing height is set by sliding the multi-material tube longitudinally within the composite tube and operating the locking tool in cooperation with both the locking tool receiver and the net height receiving fixtures to lock the multi-material tube relative to the composite tube.

The lower protective collar may prevent wear and damage to the composite tube during the installation of the upright into the built-in sleeves. Similarly, the upper protective collar may prevent wear and damage to the composite tube interior surface when the net playing height is adjusted. Furthermore, the upper protective collar may prevent wear and damage to the composite tube while operating the locking tool to lock the multi-material tube at the net playing height.

In another embodiment of the instant invention, the composite tube further includes a stop bar. The stop bar is positioned to intercept the multi-material tube prior to the rope contact end impacting the guard surface. In another embodiment of the instant invention, the multi-material tube is formed with a composite tube interior surface protective ring. The composite tube interior surface protective ring may guide the multi-material tube as it telescopes in and out of the composite tube during installation and preparation for storage and may reduce abrasion damage on the composite tube.

In another embodiment of the instant invention, a hook collar may be releasably attached to the composite tube. The hook collar may be positioned at a hook collar height measured from the sleeve support end. The hook collar secures the rope thereby holding the net in position and may reduce exterior surface damage from handling.

In another embodiment of the instant invention, the upper collar is formed with at least one locking recess. The locking recess may extend from the upper collar exterior surface to the bearing surface and may be completely within the upper collar. The net height receiving fixtures may be a plurality of pin recesses. The locking tool may be a pin that cooperates with both the locking recess and the pin recesses.

In another series of embodiments, the composite tube may be formed without a lower protective collar, if the composite material is sufficiently resistant to damage, while in others, a lower protective collar may have a lower collar attachment surface, a sleeve contact surface, a lower collar height, and at least one lower collar maximal thickness. The lower collar attachment surface may cooperate with the composite tube such that the lower protective collar is attached at the sleeve support end, and the built-in sleeve releasably receives the lower protective collar. The lower protective collar may be quite thin and light in weight, and may be metallic.

A decorative overlay may be attached to at least a portion of the composite tube exterior surface. Such an overlay provides a bright and colorful surface appearance to the upright, and may be used to feature any desire indicia, including but not limited to team logos and advertisements. In certain embodiments, the lower protective collar overlaps at least a portion of the composite tube exterior surface and a portion of the decorative overlay. Such a construction may allow a lowermost edge of the decorative overlay to be protected by a portion of the lower protective collar and may minimize peeling or other damage to the decorative overlay. Also to prevent damage, the lower protective collar height may be more than the built-in sleeve depth.

The upright of the instant invention enables a significant advance in the state of the art. The instant invention is, in addition, widely applicable to a large number of applications. The various embodiments, as would be understood by one skilled in the art, would be suitable to any recreational activity requiring light weight but rigid, durable, cost-effective uprights. These variations, modifications, alternatives, and alterations of the various preferred embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Figure 1:
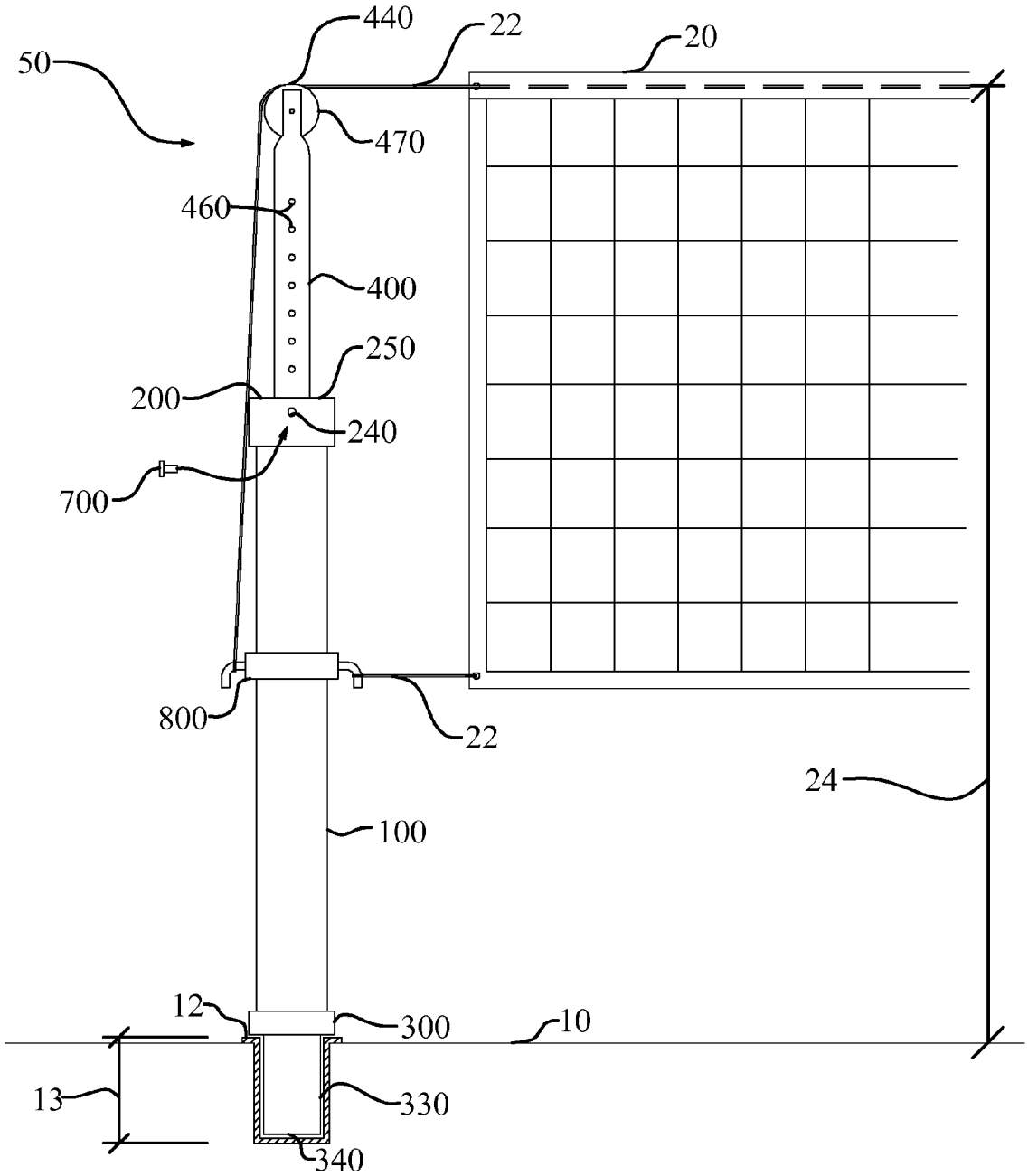
FIG. 1 is an elevated plan view of an embodiment of a composite locking upright, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The composite locking upright (50) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Referring now generally to FIGS. 1 through 18, the present invention is a composite locking upright (50) for installation into a playing surface (10) having a plurality of built-in sleeves (12). As one skilled in the art will observe and appreciate, the playing surface (10) may be found in any sports facility where the playing surface (10) satisfies multiple roles. By way of example and not limitation, the playing surface (10) may be used for indoor volleyball, badminton, and tennis, in addition to basketball or other sports not requiring uprights. The built-in sleeves (12) enable this versatility within the facility, particularly with respect to the sports requiring nets tautly secured between two uprights. The built-in sleeves (12) are typically 3, 3.5, or 4 inches in diameter and have a depth (13). The uprights (50) are slidably inserted into the sleeves (12) during setup of the playing surface (10). In an embodiment of the instant invention, as seen in FIG. 1, the composite locking upright (50) supports a net (20) at a net playing height (24) by supporting, and securing, a plurality of ropes (22). When two or more uprights (50) of the instant invention are installed into the built-in sleeves (12), the net (20) may be secured with the rope (22) at each upright (50).

With reference to FIG. 1, an embodiment of the composite locking upright (50) has a composite tube (100), an upper protective collar (200), a lower protective collar (300), a multi-material tube (400), and a locking tool (700). Now these components, in addition to their relation to one another, will be more fully described.

The composite tube (100) may be made of a combination of two or more distinct materials that may result in a high-strength, low-weight composite. By way of example, and not limitation, the composite tube (100) may be made of a combination of a reinforcement supported by a matrix material, such as a fiber reinforcement of an organic, or resin, matrix. Furthermore, the fiber reinforcement may be composed of discontinuous fibers or continuous fibers. As one skilled in the art will recognize, the fibers may be one material, such as glass, aramid, carbon, or intermulti-material fibers, to name only a few, or the fibers may be a combination of materials. The fibers may have low weight but great strength or rigidity, referred to as elastic modulus. The matrix binds the fibers together and transfers load to, and between, the individual fibers. There are a large number of resin formulations available, such as polyester and vinyl ester resins, thermoplastic resins, and epoxies. The matrix may have lower weight, rigidity, and strength than the fibers, however, the composite, the combination of the fiber and matrix, may have a high elastic modulus combined with low weight. As previously mentioned, even though the fibers have rigidity, many times the fibers weaken when damaged. Therefore, preventing damage to the composite by minimizing penetrations that segment or cut the fibers, and minimizing any damage to the composite, may improve the durability and long term performance of the composite tube (100).

Figure 2:
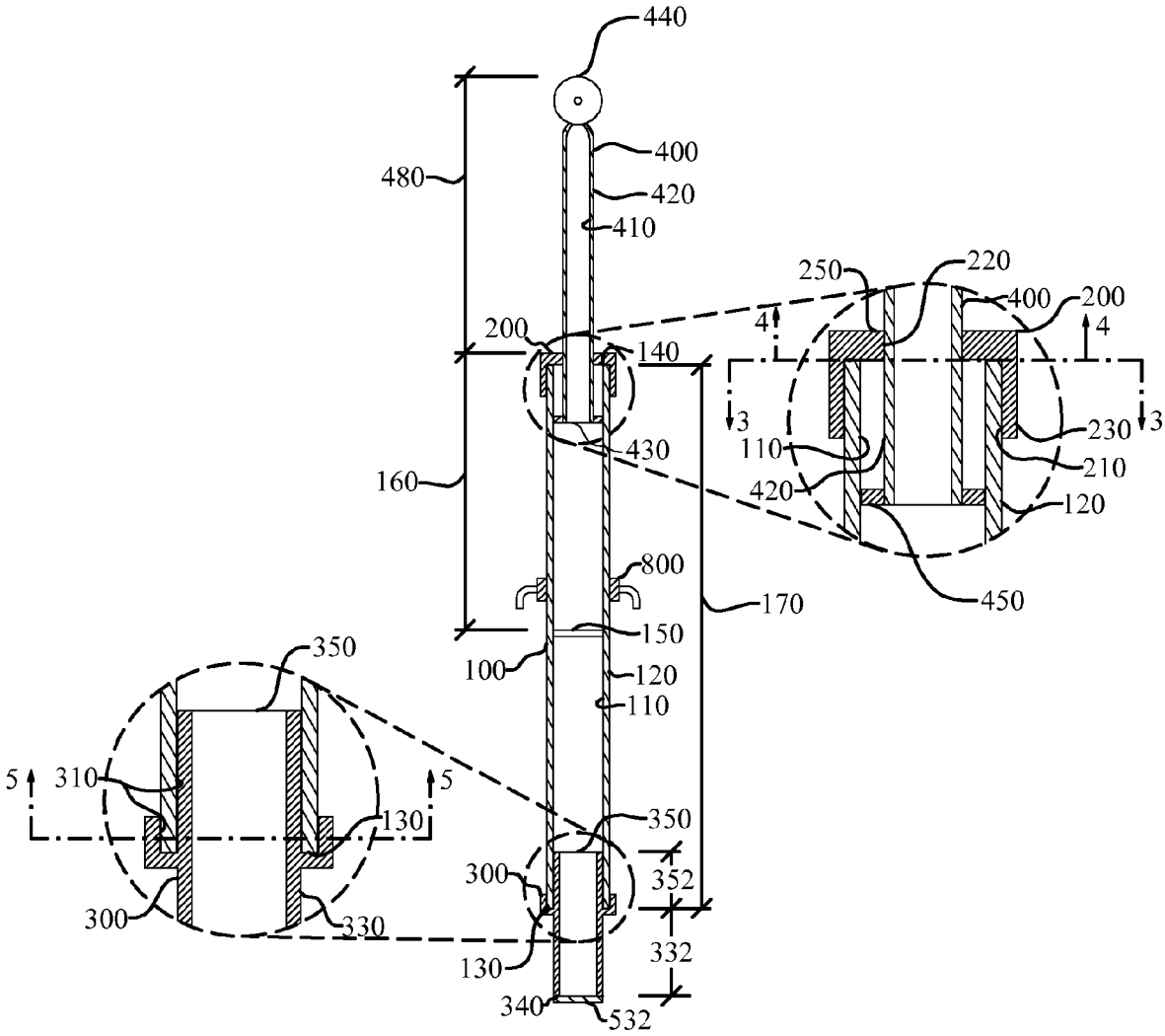
FIG. 2 is a cross-sectional view of an embodiment of the composite locking upright of FIG. 1 showing exploded cross-sectional views of embodiments of an upper and a lower protective collar, not to scale.
Figure 3:
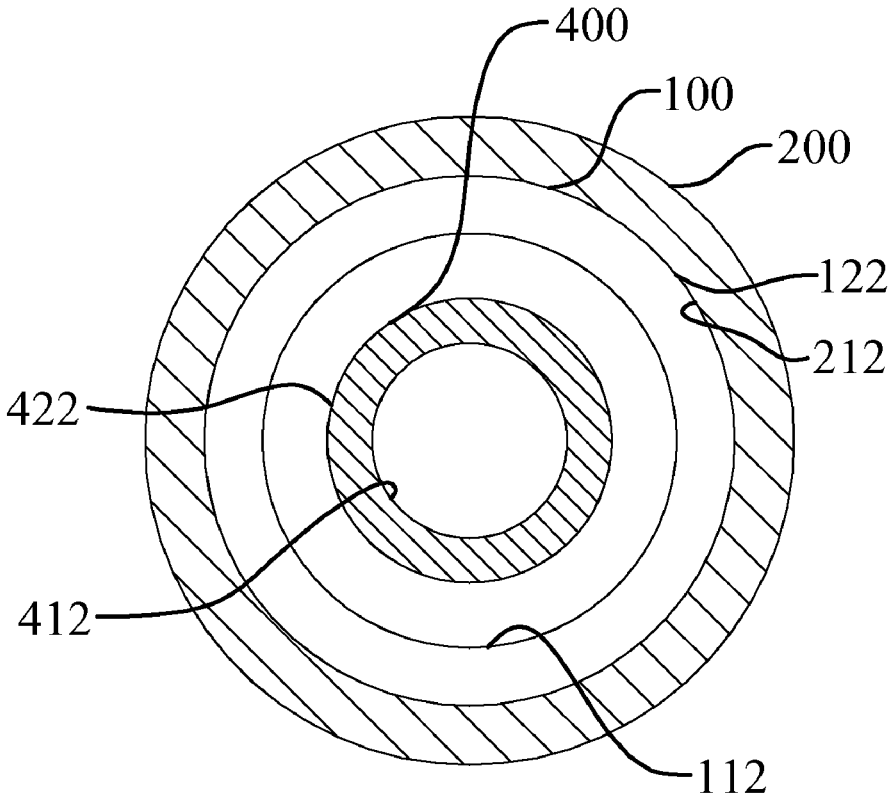
FIG. 3 is a cross-sectional view of an embodiment of an upper protective collar viewed toward an embodiment of a composite tube taken along section line 3-3 in FIG. 2, not to scale.
Figure 4:
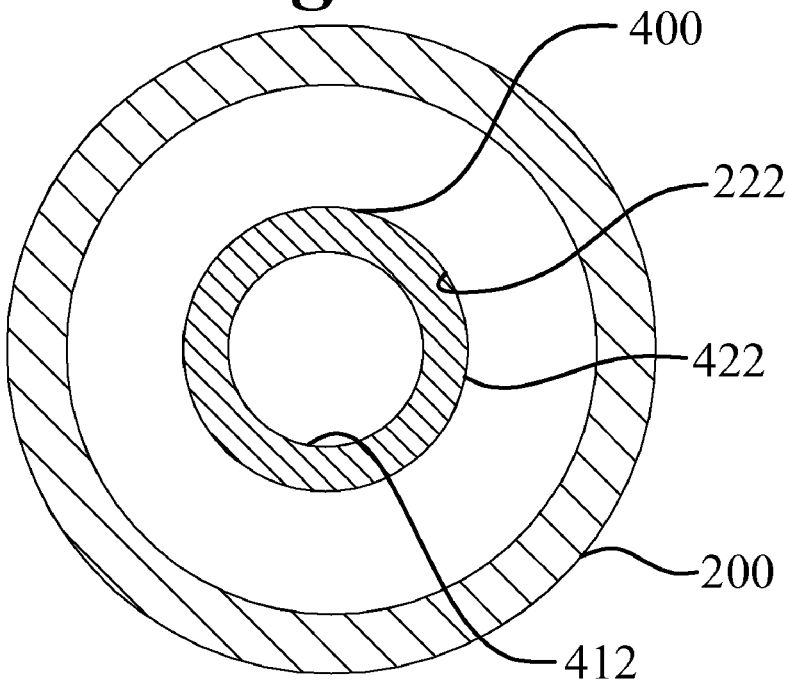
FIG. 4 is a cross-sectional view of an embodiment of an upper protective collar viewed away from an embodiment of the composite tube taken along section line 4-4 in FIG. 2, not to scale.

With reference now to FIGS. 2, 3, and 4, the composite tube (100) has a composite tube interior surface (110), a composite tube exterior surface (120), a sleeve support end (130), and a receiving end (140). The composite tube interior surface (110) is defined by a composite tube interior periphery (112), seen in FIG. 3. The composite tube exterior surface (120) is defined by a composite tube exterior periphery (122), also seen in FIG. 3. As seen in FIG. 2, the composite tube (100) has a composite tube height (170) that is measured from the sleeve support end (130) to the receiving end (140).

In one embodiment, the upper protective collar (200), as seen in FIG. 2, may have an upper collar attachment surface (210), a bearing surface (220), an upper collar exterior surface (230), and a guard surface (250), as seen best in an exploded view in FIG. 2. Referring now to FIGS. 3 and 4, the upper collar attachment surface (210) is defined by an upper collar attachment periphery (212) and the bearing surface (220) is defined by a bearing surface periphery (222). The bearing surface (220) will be described in greater detail in tandem with the description of the multi-material tube (400).

The upper collar attachment periphery (212) and the composite tube exterior periphery (122) cooperate such that the upper protective collar (200) is attached at the receiving end (140) of the composite tube (100), as seen in FIG. 2. As one skilled in the art will observe, attachment of the upper protective collar (200) to the composite tube (100) may be made by with an adhesive. By way of example only, and not limitation, the adhesive may be one that has a low density while being durable, such as a contact adhesive, urethane, and two-part, heat-cured epoxy.

The guard surface (250) and the upper collar exterior surface (230) substantially prevent damage to the receiving end (140) of the composite tube (100). Consequently, the guard surface (250) and the upper collar exterior surface (230) may substantially prevent damage to the fiber reinforcement of the composite tube (100) during handling and during adjustment of the net playing height (24). In one embodiment, as seen in FIG. 1, the upper protective collar (200) may have a locking tool receiver (240), as will be described in more detail later.

Figure 5:
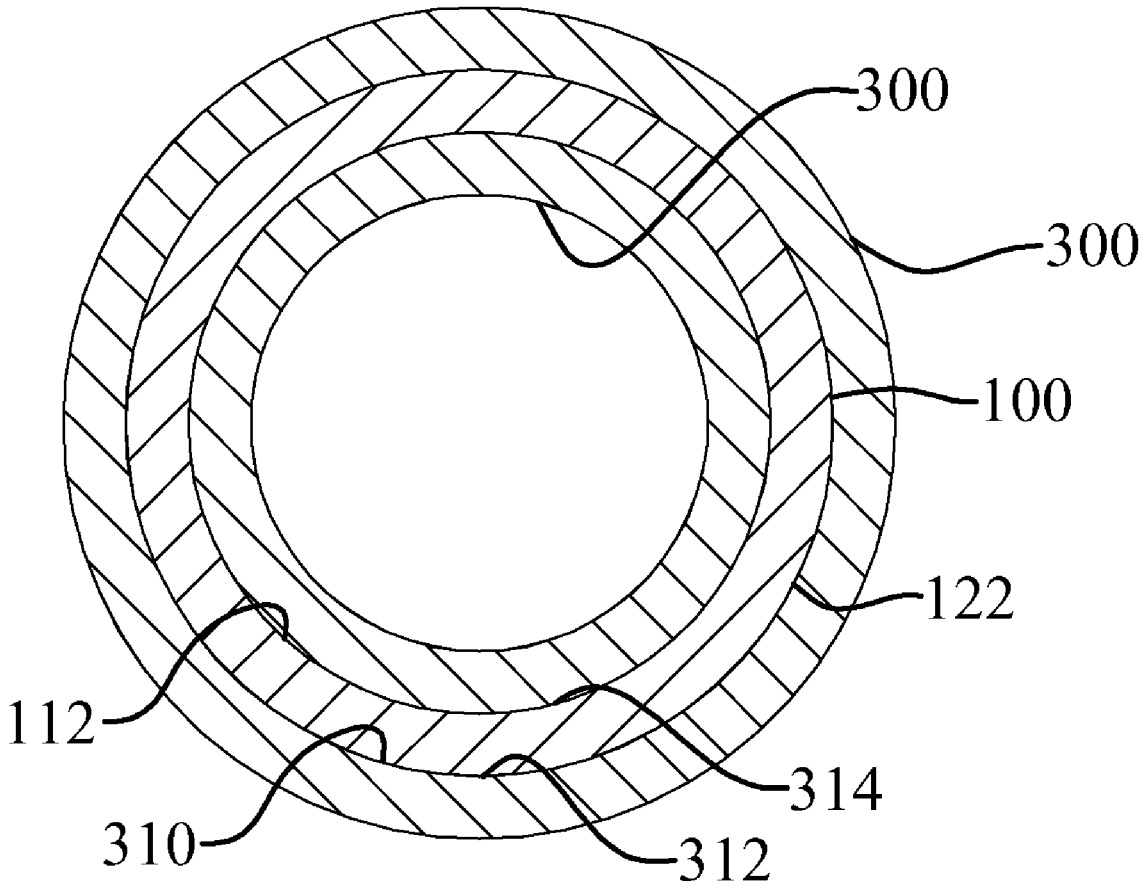
FIG. 5 is cross-sectional view of an embodiment of a lower protective collar taken along section line 5-5 in FIG. 2, not to scale.

With continued reference to FIGS. 1 and 2, in one embodiment of the composite locking upright (50), the lower protective collar (300) has a lower collar attachment surface (310), a sleeve contact surface (330), a support end (340), and a reinforcement end (350). As seen in FIG. 5, the lower collar attachment surface (310) is defined by a lower collar attachment periphery (312). The lower collar attachment periphery (312) and the composite tube exterior periphery (122) cooperate such that the lower protective collar (300) is attached at the sleeve support end (130), as seen in FIG. 2. With reference to FIG. 1, the lower protective collar (300) may cooperate with the built-in sleeve (12) which may allow the upright (50) to be installed and removed without substantially damaging the composite tube (100). As one skilled in the art will observe and appreciate, the lower protective collar (300) may be attached to the composite tube (100) by epoxy or other adhesive and additional joining strength may be realized by incorporating a pin or a bolt.

As seen in FIGS. 1 and 2, the multi-material tube (400) may protrude through the upper protective collar (200) and telescopically extends from the receiving end (140) of the composite tube (100). The multi-material tube (400), like the composite tube (100), may have a high modulus of elasticity. In other words, the multi-material tube (400) is rigid, and may be formed at least in part of the same materials discussed above in regard to the composite tube (100). Consequently, the multi-material tube (400) may not deform substantially when a net hanging force is applied.

In one embodiment of the present invention, as seen in FIGS. 1 and 2, the multi-material tube (400) may have a multi-material tube interior surface (410), a multi-material tube exterior surface (420), an insertion end (430), and a rope contact end (440). The multi-material tube exterior surface (420) may be formed with a plurality of net height receiving fixtures (460). By way of example, and not limitation, the net height receiving fixtures (460) may be indentations, protrusions, or marks formed into the multi-material tube exterior surface (420) for facilitating setting the net playing height (24). Referring now to FIGS. 3 and 4, the multi-material tube exterior surface (420) is defined by a multi-material tube exterior periphery (422) that cooperates with the bearing surface periphery (222). The multi-material tube (400) telescopes in and out of the composite tube (100) and may be fixed with the locking tool (700) operating in conjunction with the locking tool receiver (240) and the net height receiving fixtures (460).

In one embodiment, seen well in FIGS. 14-18, the multi-material tube (400) may be formed with at least one abrasion resistant section (405). An abrasion resistant section is intended to include a section made of any material having a higher abrasion resistance than that of the remaining material comprising the multi-material tube (400). In one embodiment, the abrasion resistant section (405) may be formed of metal, and in a particular embodiment, may be formed of steel. Such an abrasion resistant section (405) allows at least one of the plurality of net height receiving fixtures (460) to be placed in an area where there will be decreased chances of damaging the multi-material tube (400). By way of example only, it is well known that certain types of multi-material tubes (400), such as those formed of certain composites, are vulnerable to abrasion, chipping, or fracture, particularly in areas of pressure or areas of perforations through such a multi-material tube (400).

Figure 15:
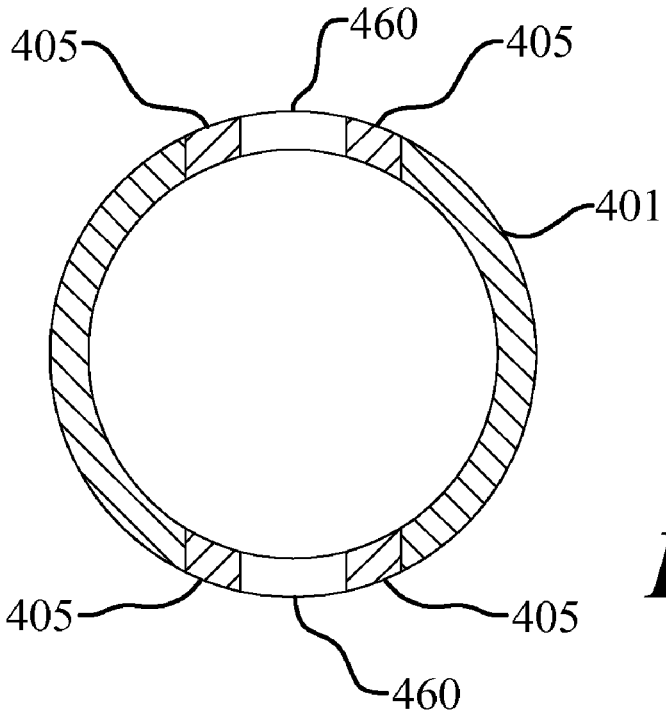
FIG. 15 is a cross-sectional view of an embodiment of the upper protective collar taken along section line 15-15 in FIG. 13, not to scale.
Figure 16:
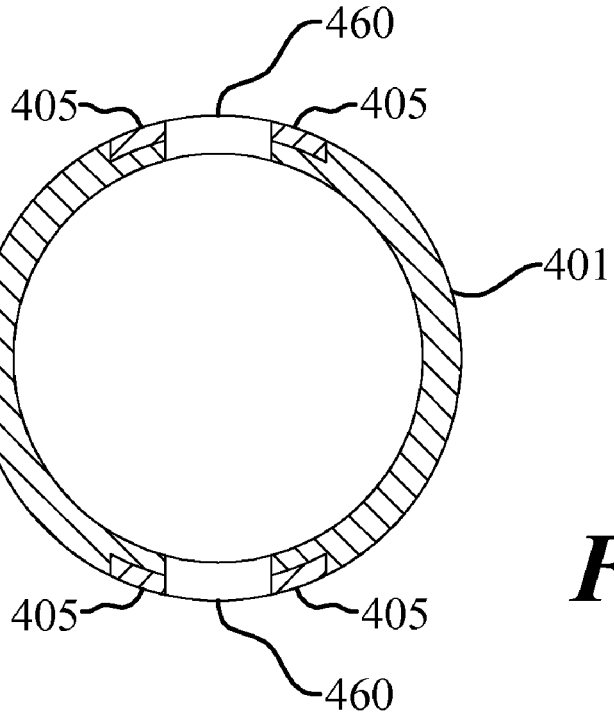
FIG. 16 is a cross-sectional view of an embodiment of the upper protective collar taken along section line 16-16 in FIG. 14, not to scale.
Figure 17:
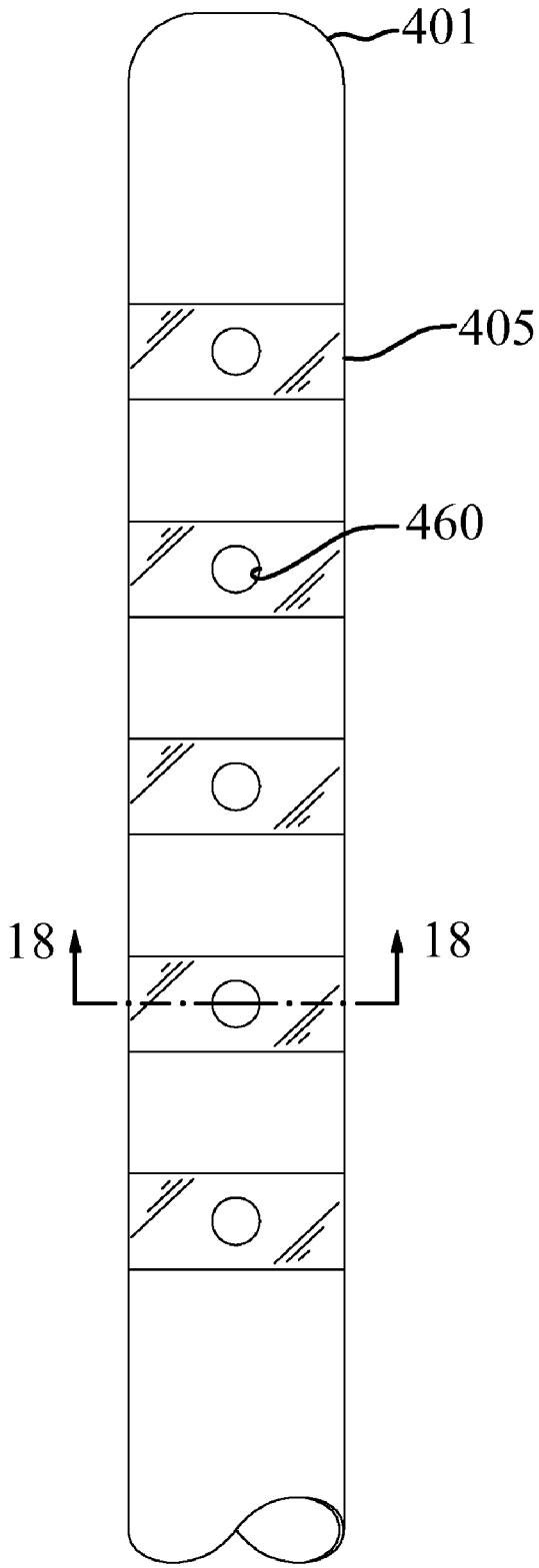
FIG. 17 is elevated plan view of another embodiment of a multi-material tube showing a multi-material tube having an abrasion resistant insert, not to scale.
Figure 18:
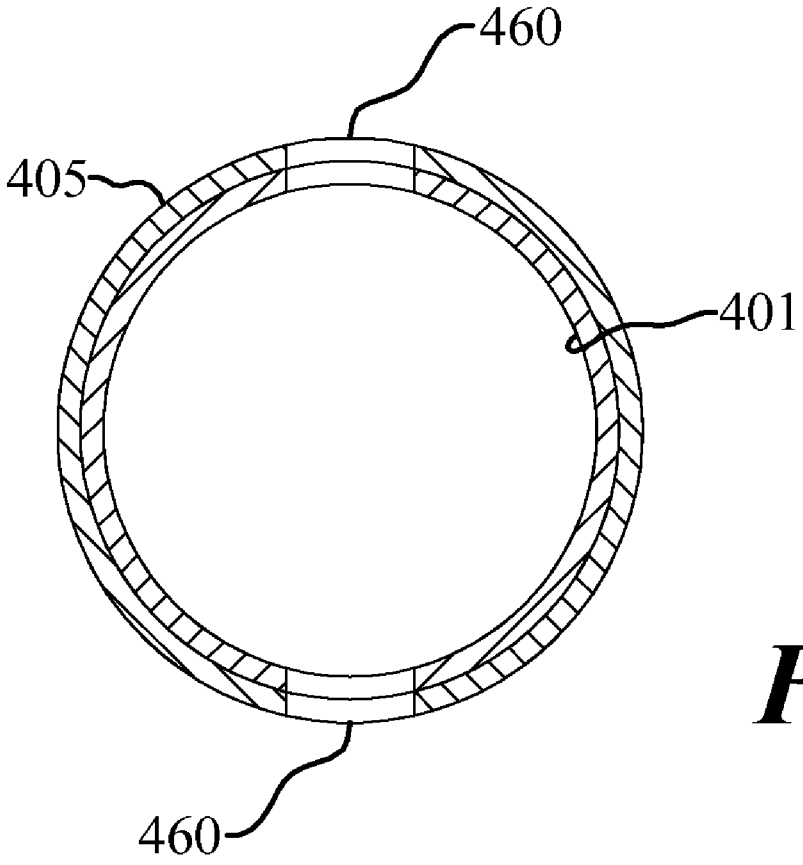
FIG. 18 is a cross-sectional view of an embodiment of the upper protective collar taken along section line 18-18 in FIG. 17, not to scale.

Placement of an abrasion resistant section (405) in a multi-material tube, wherein at least one of the plurality of net receiving fixtures (460) is at least partially set within at least one of the at least one abrasion resistant sections (405), helps protect the multi-material tube (400). Such an abrasion resistant section (405) may be a section that may be equal to a full thickness of the multi-material tube (400) as seen in FIG. 15. Alternatively, an abrasion resistant section (405) may be a section that may be equal to a full thickness of the multi-material tube (400) as seen in FIG. 16. One skilled in the art would appreciate that a plurality of materials may be useful to use as the basis for the abrasion resistant section (405), which, as above, may be formed of metal or be may fabricated of another abrasion resistant material. One skilled in the art will realize that such an abrasion resistant section (405) may be fabricated in a wide variety of shapes and designs, only some of which are seen illustrated in FIGS. 14-18.

In order to protect the composite tube (100), as seen in FIG. 2, as the multi-material tube (400) slides longitudinally within the composite tube (100), the multi-material tube exterior surface (420) slides against the bearing surface (220) of the upper protective collar (200). The bearing surface (220) substantially prevents the multi-material tube exterior surface (420) from damaging the composite tube interior surface (110).

As seen in FIG. 2, the insertion end (430) resides within the composite tube (100) so that at a maximum extension (480) of the multi-material tube (400) from the composite tube (100), the rigidity of the upright (50) may not be compromised. The various positions of the multi-material tube (400) relative to the composite tube (400) may be locked by the locking tool (700), as seen in FIG. 1. The locking tool (700) may take a number of forms, by way of example and not limitation, the locking tool (700) may be a compression ring, a fork, or another device that cooperates with the locking tool receiver (240) and net height receiving fixtures (460) to lock the composite tube (100) with respect to the multi-material tube (400).

During installation, when the rope (22) is threaded onto the rope contact end (440), the net (20) thereby releasably attaching the net (20) to the composite locking upright (50) and the net playing height (24) is set by sliding the multi-material tube (400) longitudinally within the composite tube (100) and operating the locking tool (700) in cooperation with both the locking tool receiver (240) and the net height receiving fixtures (460) to lock the multi-material tube (400) relative to the composite tube (100).

The upper and lower protective collars (200, 300) may be made of steel or other material, or may be made of a light weight material with a hard, abrasive resistant coating, that resists repetitious use of the composite locking upright (50) and that holds the multi-material tube (400) at the net playing height (24). In particular, the lower protective collar (300) may prevent wear and damage to the composite tube (100) during the installation of the upright (50) into the built-in sleeves (12) and from relative movement between the lower protective collar (300) and the built-in sleeve (12) during use of the upright (50). Similarly, the upper protective collar (200) may prevent wear and damage to the composite tube interior surface (110) when the net playing height (24) is adjusted. In addition, the upper protective collar (200) may prevent wear and damage to the composite tube (100) while operating the locking tool (700) to lock the multi-material tube (400) at the net playing height (24). In one embodiment of the instant invention, the composite tube (100) is not penetrated, and any penetrations are formed in the upper and lower protective collars (200, 300).

Figure 6:
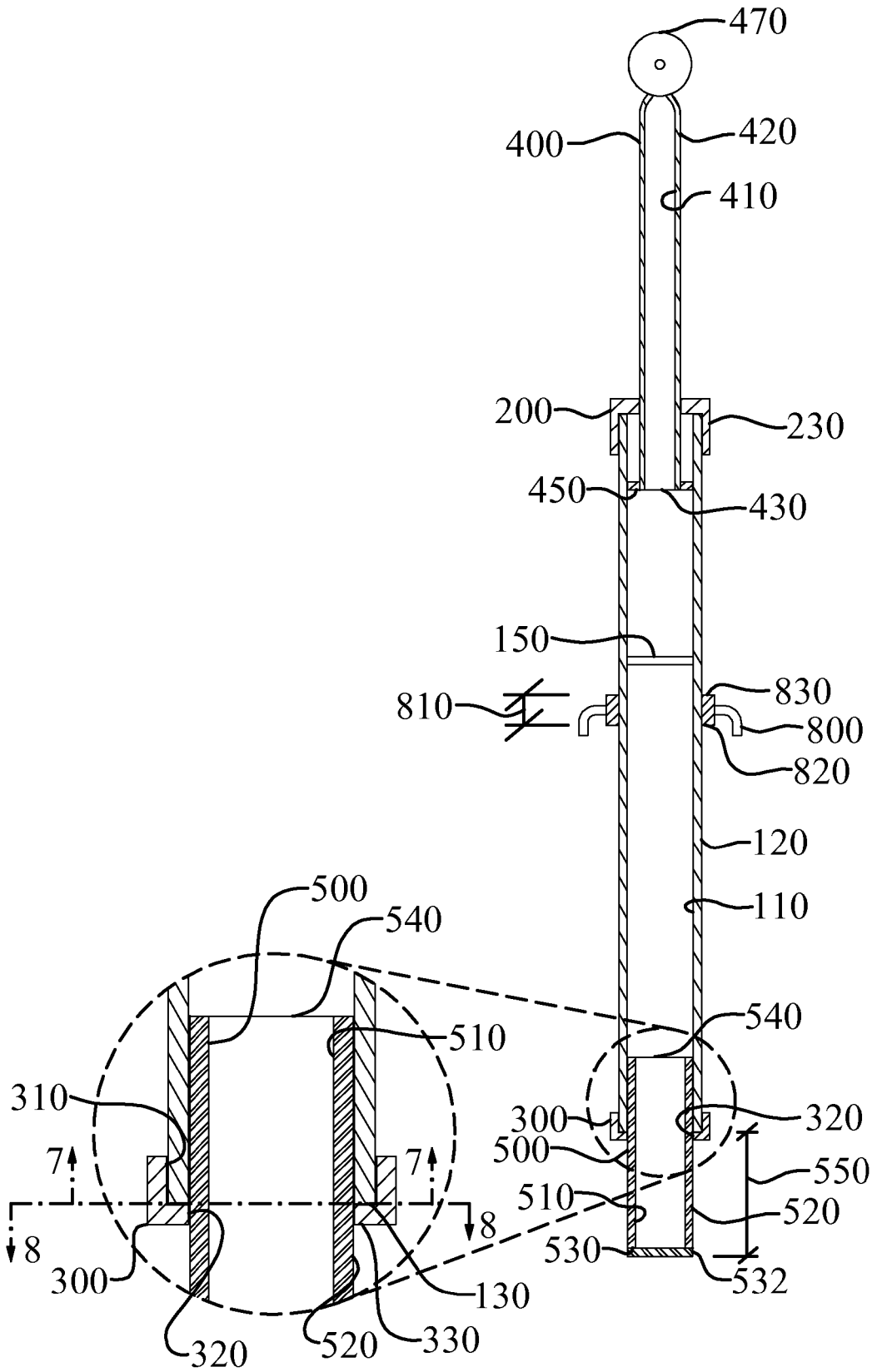
FIG. 6 is a cross-sectional view of an embodiment of the composite locking upright from FIG. 1 showing an exploded cross-sectional view of an embodiment of the lower protective collar and a bottom insert, not to scale.
Figure 10:
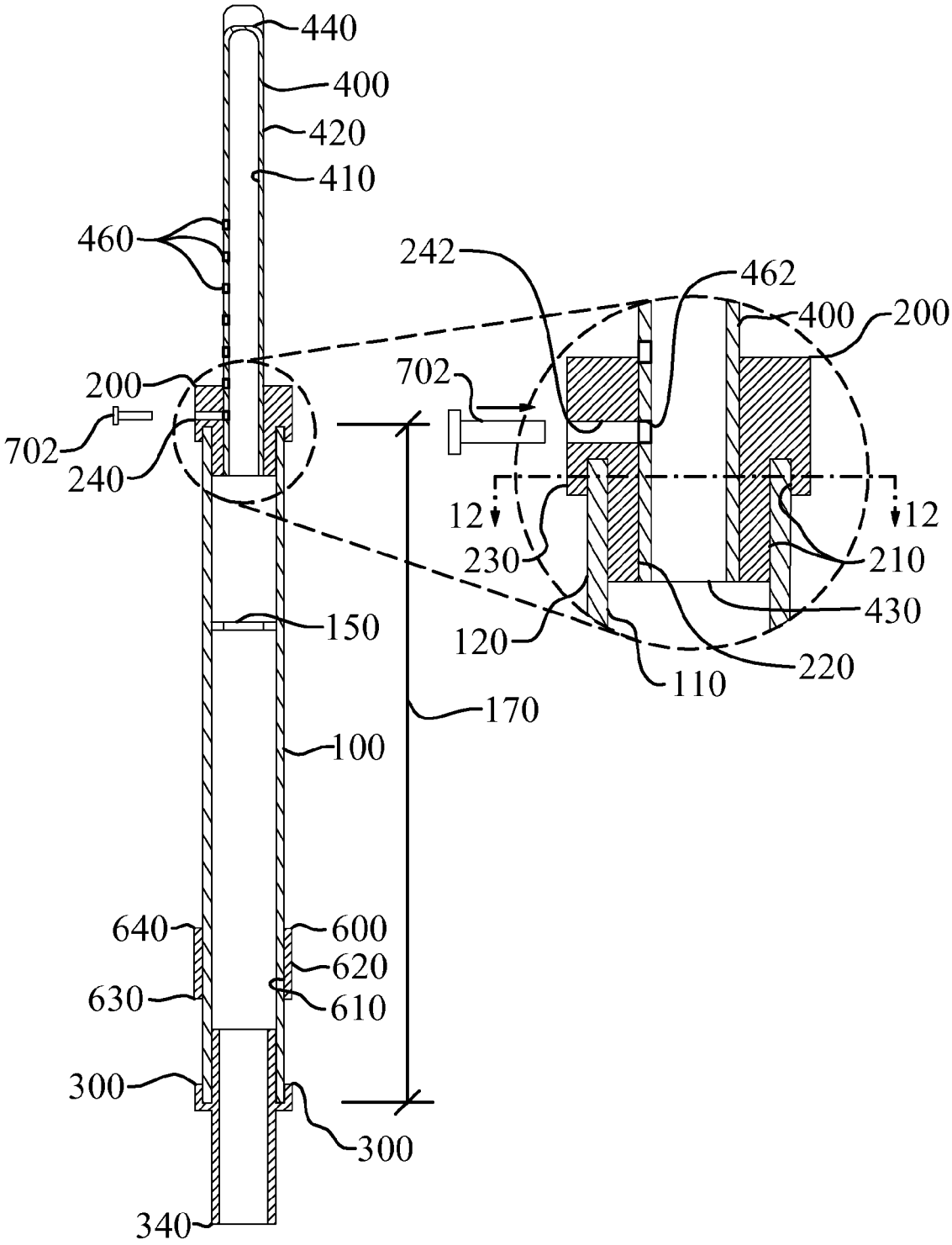
FIG. 10 is a cross-sectional view of an embodiment of the composite locking upright of FIG. 9 showing exploded cross-sectional views of embodiments of the upper and the lower protective collar, not to scale.

In another embodiment of the instant invention, as seen in FIGS. 2, 6, and 10, the composite tube (100) further includes a stop bar (150). The stop bar (150) is positioned on the composite tube interior surface (110). As one skilled in the art will recognize and appreciate, the stop bar (150) may be other than a bar, for instance, the stop bar (150) may be a restriction formed inside the composite tube (100), as seen in FIG. 10. The stop bar (150) is positioned to intercept the multi-material tube (400) prior to the rope contact end (440) impacting the guard surface (250). The stop bar (150) is located at a drop distance (160), seen in FIG. 2, from the guard surface (250). In other words, if the multi-material tube (400) is allowed to drop in an uncontrolled manner, the stop bar (150) may stop the multi-material tube's (400) descent, thus substantially preventing the composite tube (100) from being damaged. In one embodiment of the composite locking upright (50), as seen in FIG. 2, the drop distance (160) may be less than the maximum extension (480).

Figure 12:
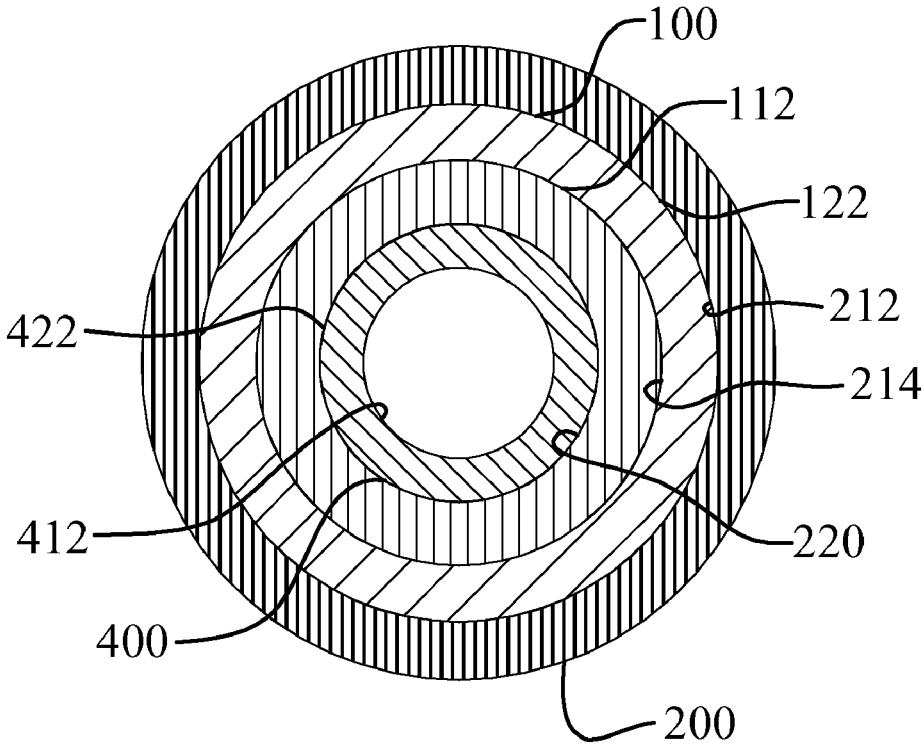
FIG. 12 is a cross-sectional view of an embodiment of the upper protective collar taken along section line 12-12 in FIG. 10, not to scale.
Figure 13:
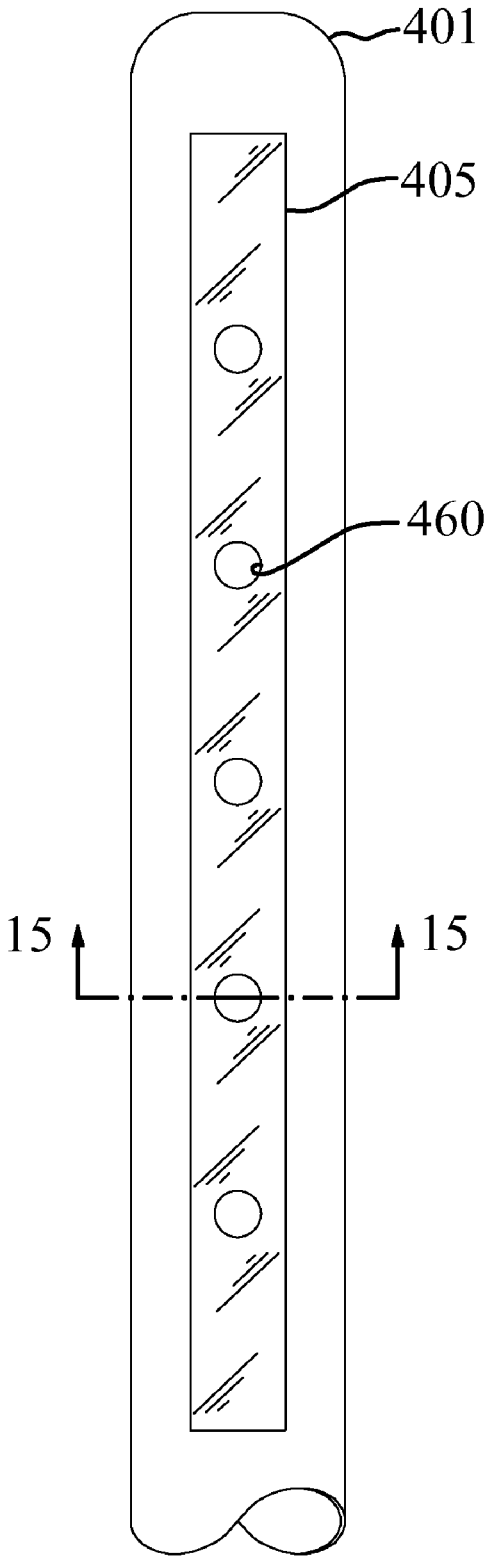
FIG. 13 is an elevated plan view of an embodiment of a multi-material tube showing a multi-material tube having an abrasion resistant insert, not to scale.
Figure 14:
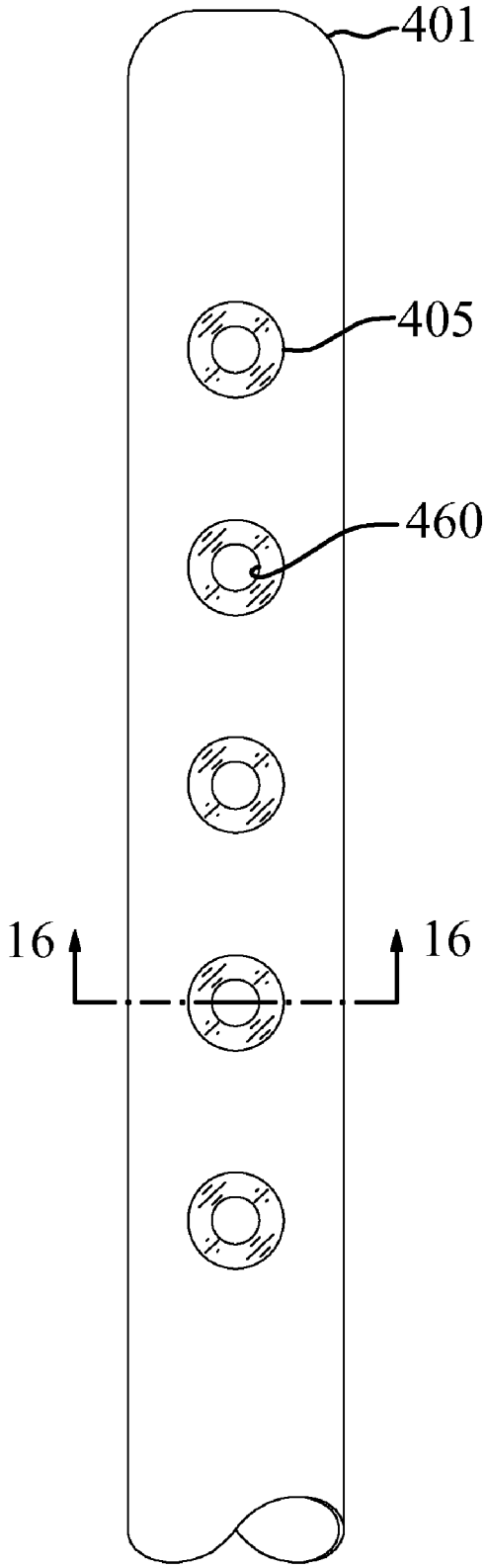
FIG. 14 is elevated plan view of another embodiment of a multi-material tube showing a multi-material tube having an abrasion resistant insert, not to scale.

In another embodiment of the instant invention, as seen in FIGS. 10 and 12, the upper collar attachment surface (210) has an interior upper collar attachment periphery (214). As best seen in FIG. 12, the interior upper collar attachment periphery (214) cooperates with the composite tube interior periphery (112). Essentially, a channel is formed in the upper protective collar (200), and the upper collar attachment surface (210) has a portion that may contact the composite tube interior surface (110) and a portion that may contact the composite tube exterior surface (120). As previously described, the upper collar attachment periphery (212) cooperates with the composite tube exterior periphery (122). Thus, the upper collar (200) may be attached to the receiving end (140) of the composite tube (100) with the upper collar attachment surface (210) substantially contacting both the composite tube interior surface (110) and the composite tube exterior surface (120).

In another embodiment of the composite locking upright (50), as seen in FIG. 2, the lower collar attachment surface (310) is defined by an interior lower collar attachment periphery (314). A lower collar channel is formed where the lower collar attachment surface (310) has a portion that may be attached to the composite tube exterior surface (120) and a portion that may be attached to the composite tube interior surface (110). The sleeve contact surface (330) has a sleeve contact surface length (352). The interior lower collar attachment periphery (314) cooperates with the composite tube interior periphery (112) whereby the lower protective collar (300) is attached to the sleeve support end (130) of the composite tube (100) with the lower collar attachment surface (310) substantially contacting both the composite tube interior surface (110) and the composite tube exterior surface (120).

With continued reference to FIG. 2, in another embodiment of the instant invention, the lower protective collar (300) has a reinforcement end (350). The reinforcement end (350) extends into the composite tube (100) to a reinforcement length (352). The reinforcement length (352) is measured from the sleeve support end (130) of the composite tube (100) to the reinforcement end (350) of the lower protective collar (300).

In another embodiment of the instant invention, as seen in FIGS. 1 and 6, the multi-material tube (400) has a pulley wheel (470) rotatably attached to the rope contact end (440). In another embodiment, the rope contact end (440) is a grooved end, as seen in FIG. 10.

In yet another embodiment of the instant invention, as seen in FIGS. 2 and 6, the multi-material tube (400) is formed with a composite tube interior surface protective ring (450). The composite tube interior surface protective ring (450) extends outwardly from the multi-material tube exterior surface (420). The composite tube interior surface protective ring (450) may guide the multi-material tube (400) as it telescopes in and out of the composite tube (100) during installation and preparation for storage. The composite tube interior surface protective ring (450) may also substantially prevent the multi-material tube (400) from contacting the composite tube (100) and may improve rigidity between the multi-material tube (400) and the composite tube (100) by helping distribute the load of the net between the multi-material tube (400) and the composite tube (100) other than through the upper protective collar (200).

Figure 7:
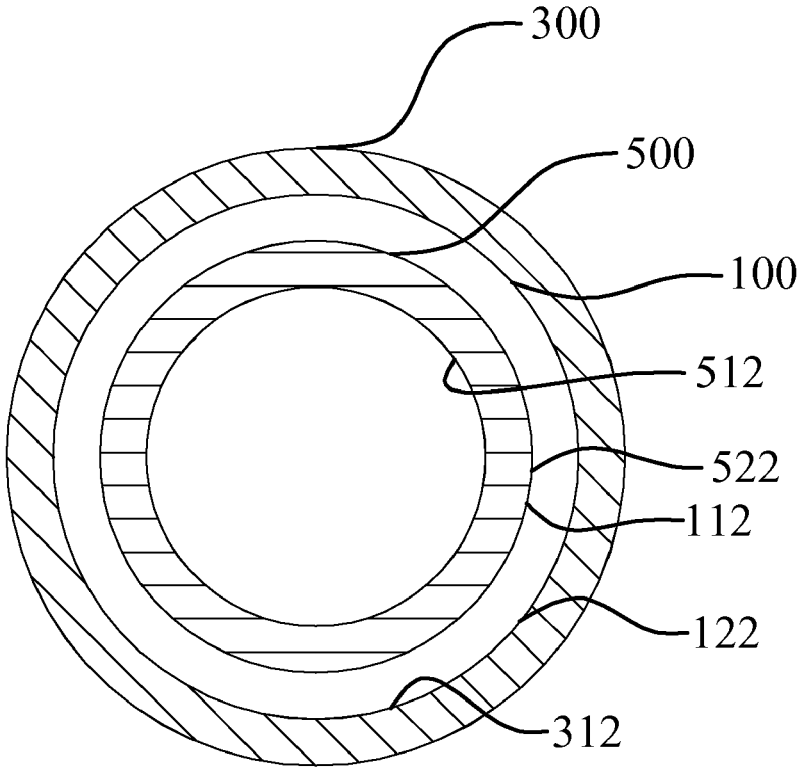
FIG. 7 is a cross-sectional view of an embodiment of a lower protective collar and insert viewed toward an embodiment of the composite tube taken along section line 6-6 in FIG. 6, not to scale.
Figure 8:
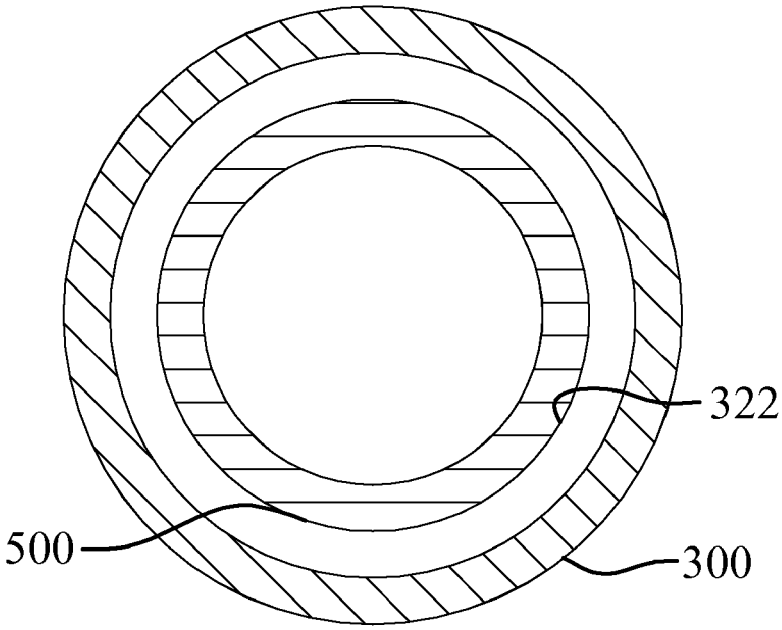
FIG. 8 is a cross-sectional view of an embodiment of a lower protective collar viewed away from an embodiment of the composite tube taken along section line 8-8 in FIG. 6, not to scale.

In another embodiment of the instant invention, as seen in FIG. 6, a bottom insert (500) may be attached to the composite tube (100) and the lower protective collar (300). The bottom insert (500) has a bottom insert interior surface (510), a bottom insert exterior surface (520), a bottom insert insertion end (530), a composite tube reinforcement end (540), and a bottom insert insertion length (550). As seen in FIGS. 7 and 8, like the collars (200, 300), the bottom insert exterior surface (520) is defined by an insert exterior periphery (522) that cooperates with the composite tube interior periphery (112) and may cooperate the lower protective collar (300) having an insert contact surface (320) with an insert contact periphery (322). In another embodiment, the composite tube reinforcement end (540) resides within the composite tube (100). The bottom insert (500) attaches to the composite tube (100) with adhesive, much like (200, 300). The bottom insert insertion end (530) extends longitudinally from the composite tube (100) by the bottom insert insertion length (550). The bottom insert insertion length (550) may be measured from the sleeve support end (130) to the bottom insert insertion end (530). In this embodiment of the instant invention, the bottom insert (500) cooperates with the built-in sleeve (12) instead of the lower protective collar (200). In another embodiment of the instant invention, as seen in FIG. 6, an end plug (532) is attached to the bottom insert insertion end (530). In another embodiment, as seen in FIG. 2, the end plug (532) may be attached to the lower protective collar (300). The end plug (532) may be made of rubber or plastic and may prevent damage to the playing surface (10) or the built-in sleeve (12) during installation and removal of the composite locking upright (50).

Figure 9:
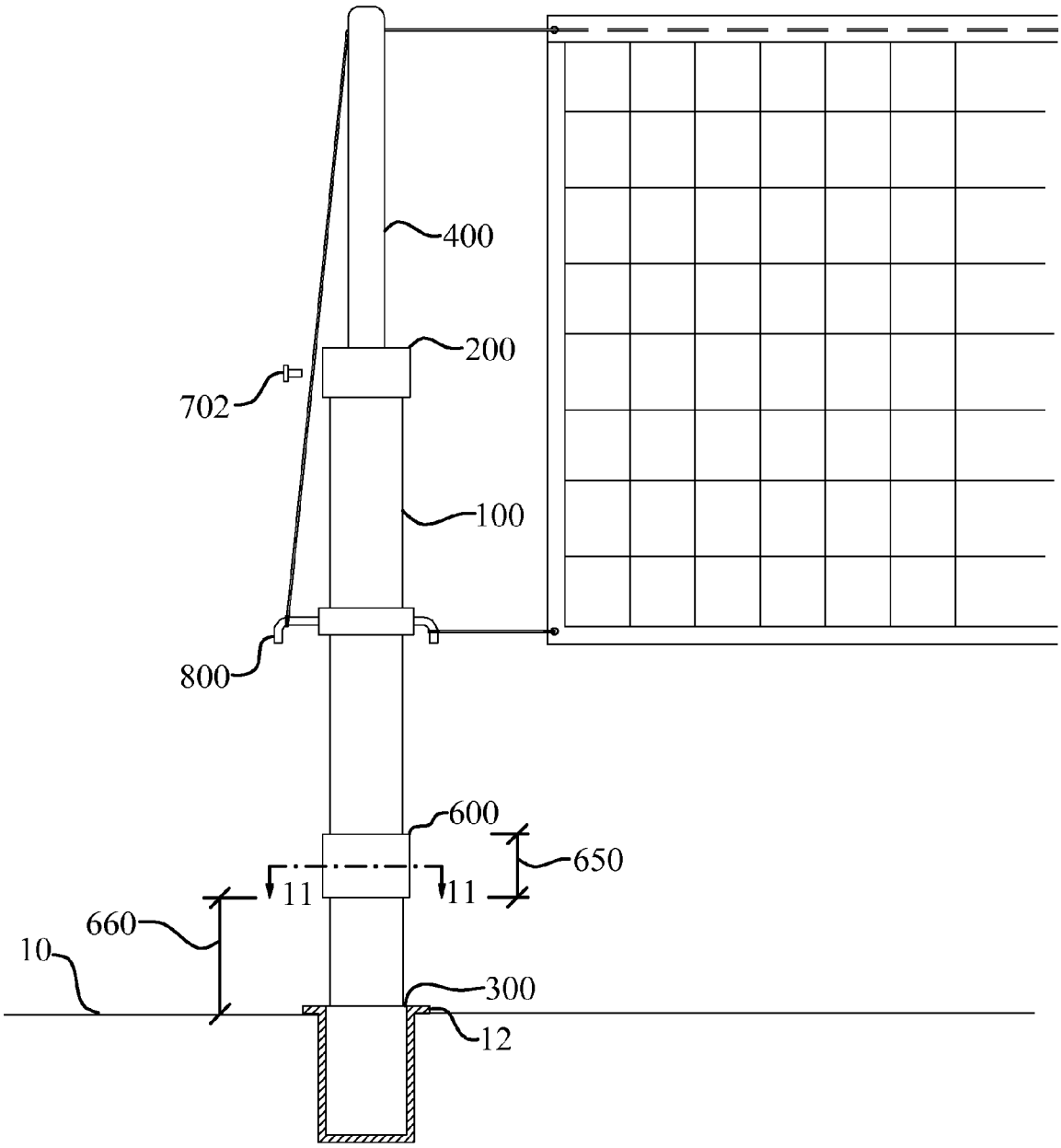
FIG. 9 is an elevated plan view of an embodiment of the composite locking upright showing an embodiment of a reinforcing collar, not to scale.
Figure 11:
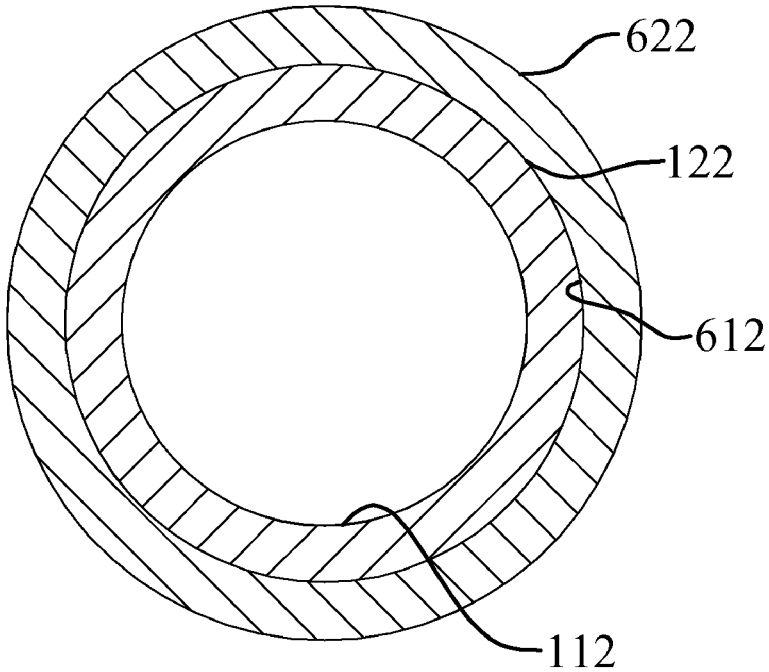
FIG. 11 is a cross-sectional view of an embodiment of a reinforcing collar taken along section line 11-11 in FIG. 9, not to scale.

In another embodiment of the instant invention, as seen in FIG. 9, a reinforcing collar (600) may be attached to the composite tube exterior surface (120). It is not necessary that the reinforcing collar be permanently attached. As one skilled in the art will observe and appreciate, the reinforcing collar (600) may be releasably attached such that the reinforcing collar (600) may provide compressive stresses in the composite tube exterior surface (120), as well as shielding the composite tube (100) from damage. As seen in FIG. 10, the reinforcing collar has a reinforcing interior surface (610), a reinforcing exterior surface (620), a reinforcement bottom edge (630), and a reinforcement top edge (640). As seen in FIGS. 10 and 11, the reinforcing interior surface (610) may be defined by a reinforcing interior periphery (612) and the reinforcing exterior surface (620) may be defined by a reinforcing exterior periphery (622). The reinforcing interior periphery (612) cooperates with the composite tube exterior periphery (122). In the embodiment where the reinforcing collar (600) may be releasably attached to the composite tube (100), the reinforcing collar (600) position on the composite tube (100) may vary by a gap distance (660). As seen in FIG. 9, the gap distance (660) may be measured from the playing surface (10) to the reinforcement bottom edge (630). Therefore, the reinforcing collar (600) may abut the lower protective collar (300) or may abut the upper protective collar (200). A reinforcing collar length (650) is measured from the reinforcement top edge (640) to the reinforcement bottom edge (630). In one embodiment of the instant invention, the reinforcing collar length (640) may be between approximately 5 and approximately 50 percent of the composite tube height (170).

In another embodiment of the instant invention, as seen in FIGS. 1, 2, and 6, a hook collar (800) may be releasably attached to the composite tube (100). The hook collar (800) has a hook collar height (810) measured from a hook collar bottom edge (820) to a hook collar top edge (830), as seen in FIG. 6. In another embodiment of the instant invention, the hook collar height (810) is between approximately 5 and approximately 50 percent of the composite tube height (170). The hook collar (800) may secure the rope (22) thereby holding the net (20) in position.

In another embodiment of the instant invention, as seen best seen in FIG. 10, the locking tool receiver (240) is formed with at least one locking recess (242). The locking recess (242) extends from the upper collar exterior surface (230) to the bearing surface (220) and may be completely within the upper collar (200), that is, as previously stated, the composite tube (100) may not be perforated. In the same embodiment of the instant invention, the net height receiving fixtures (460) are a plurality of pin recesses (462). The pin recesses (462) may extend from the multi-material tube exterior surface (420) to the multi-material tube interior surface (410). The pin recesses (462) may be spaced longitudinally along the multi-material tube (400), and the locking tool (700) may be a pin (702) that cooperates with both the locking recess (242) and the pin recesses (462).

In one embodiment, seen well in FIGS. 14-18, the multi-material tube (400) may be formed with at least one abrasion resistant section (405). Such an abrasion resistant section (405) allows at least one of the plurality of pin recesses (462) to be placed in an area where there will be decreased chances of damaging the multi-material tube (400). By way of example only, it is well known that certain types of multi-material tubes (400), such as those formed of certain composites, are vulnerable to abrasion, chipping, or fracture, particularly in areas of pressure or areas of perforations through such a multi-material tube (400). Placement of an abrasion resistant section (405) in a multi-material tube, wherein at least one of the plurality of pin recesses (462) is at least partially set within at least one of the at least one abrasion resistant sections (405), helps protect the multi-material tube (400), as well illustrated in FIGS. 13, 14, and 17.

Such an abrasion resistant section (405) may be a section that may be equal to a full thickness of the multi-material tube (400) as seen in FIG. 15. Alternatively, an abrasion resistant section (405) may be a section that may be equal to a full thickness of the multi-material tube (400) as seen in FIG. 16. One skilled in the art would appreciate that a plurality of materials may be useful to use as the basis for the abrasion resistant section (405), which, as above, may be formed of metal or be may fabricated of another abrasion resistant material. One skilled in the art will realize that such an abrasion resistant section (405) may be fabricated in a wide variety of shapes and designs, only some of which are seen illustrated in FIGS. 14-18.

Therefore, the pin (702), together with both the locking recess (242) and the pin recesses (462), locks the multi-material tube (400) relative to the composite tube (400). In another embodiment of the instant invention, the spacing of the pin recesses (462) may correspond to volleyball regulation standard net heights.

In another series of embodiments, seen in FIGS. 19-23, a composite locking upright (50) for installation into a playing surface (10), as seen in FIG. 1, has a built-in sleeve (12), and following installation, that is, while in use, the upright (50) is reversibly placed into the built-in sleeve (12). The upright (50) supports a net (20) having a rope (22) at a net playing height (24) by supporting, and securing, the rope (22).

Figure 21:
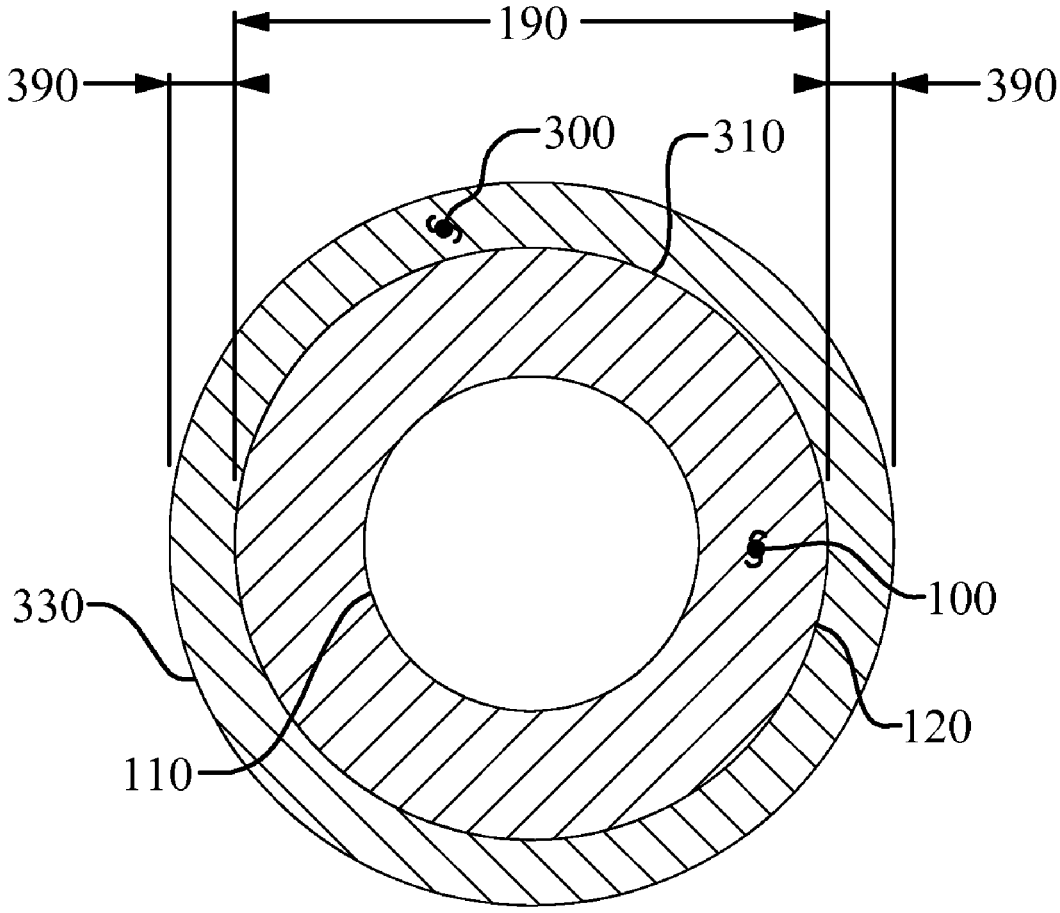
FIG. 21 is a cross-sectional view of an embodiment of the upper protective collar taken along section line 21-21 in FIG. 20, not to scale.
Figure 23:
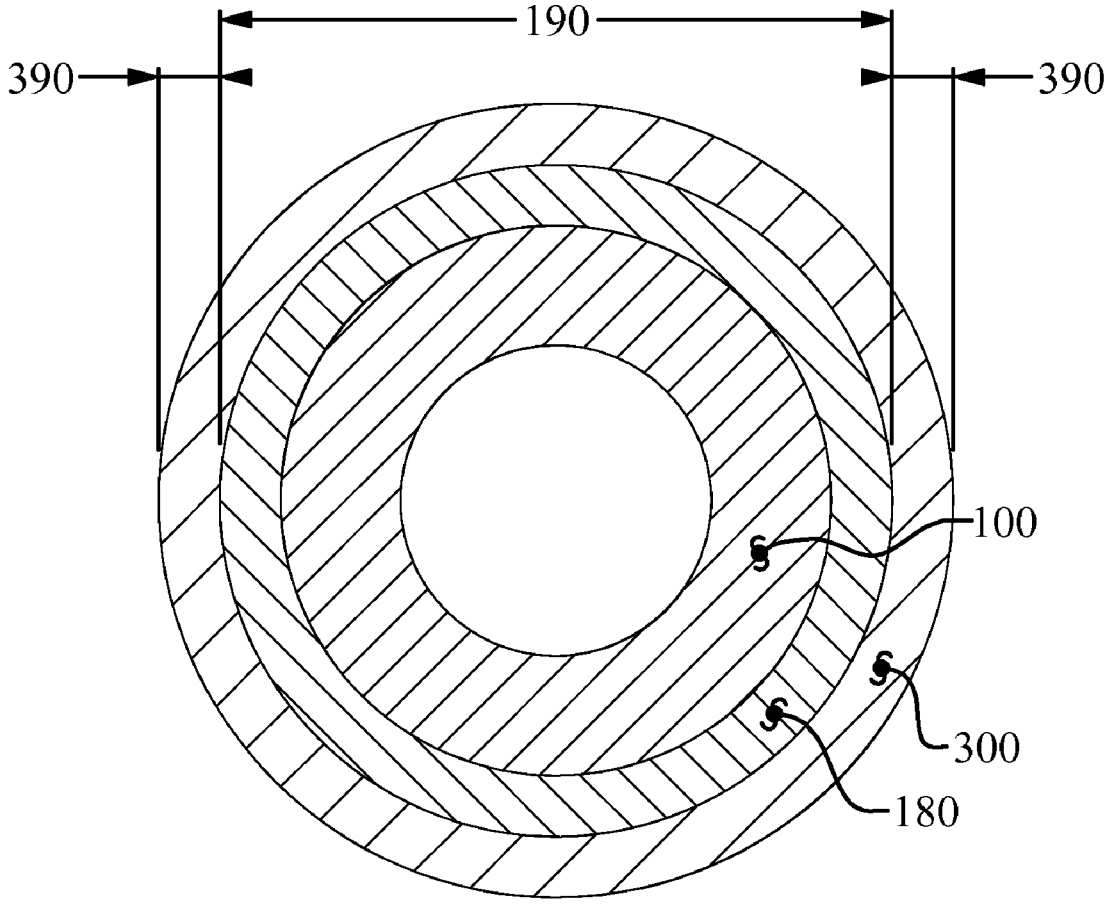
FIG. 23 is a cross-sectional view of an embodiment of the upper protective collar taken along section line 23-23 in FIG. 22, not to scale.

As seen well in FIG. 2, the upright (50), includes a composite tube (100) having a composite tube interior surface (110), a composite tube exterior surface (120), a sleeve support end (130), a receiving end (140), and a composite tube maximal diameter (190), seen in FIGS. 21 and 23. The composite tube interior surface (110) is defined by a composite tube interior periphery (112), the composite tube exterior surface (120) is defined by a composite tube exterior periphery (122), and a composite tube height (170) is measured from the sleeve support end (130) to the receiving end (140), as seen well in FIGS. 2 and 3.

Seen well in FIGS. 2, 4, and 10; there may be an upper protective collar (200) having a bearing surface (220), a locking tool receiver (240), and a guard surface (250), and the bearing surface (220) may be defined by a bearing surface periphery (222), with the upper protective collar (200) attached at the receiving end (140) of the composite tube (100).

Figure 20:
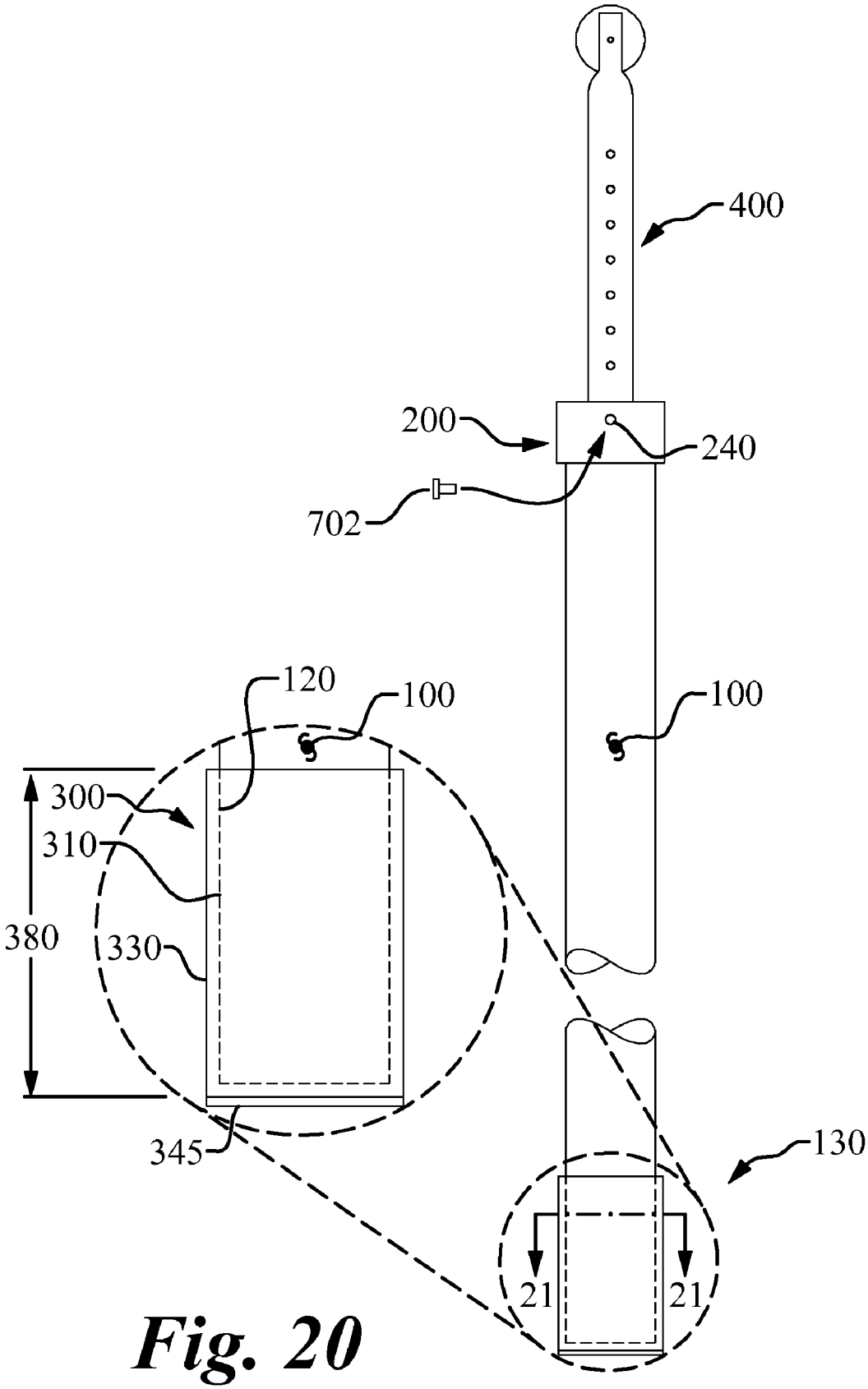
FIG. 20 is an elevation view of another embodiment of a composite locking upright, not to scale, with an enlarged insert illustration of part of the Figure.

As may be seen in at least one embodiment in FIGS. 1, 2, and 20, a lower protective collar (300) may have a lower collar attachment surface (310) a sleeve contact surface (330), a lower collar support end (340), a lower collar height (380), and at least one lower collar maximal thickness (390). In these embodiments, shown for illustration only and not by way of limitation, the lower collar attachment surface (310) may cooperate with the composite tube (100) such that the lower protective collar (300) is attached at the sleeve support end (130), and the built-in sleeve (12) releasably receives the lower protective collar (300) thereby substantially preventing the built-in sleeve (12) from damaging the composite tube (100).

A multi-material tube (400), seen well in FIG. 2, may have having a multi-material tube interior surface (410), a multi-material tube exterior surface (420), and at least one abrasion resistant section (405), seen in FIGS. 13-18. There may be an insertion end (430), and a rope contact end (440), wherein the multi-material tube exterior surface (420), as may be seen in FIG. 2, and may be formed with a plurality of net height receiving fixtures (460), again as seen in FIGS. 13-18. At least one of the plurality of net height receiving fixtures (460) is at least partially set within at least one of the abrasion resistant sections (405). The multi-material tube exterior surface (420), as may be seen in FIG. 4, may be defined by a multi-material tube exterior periphery (422) that cooperates with the bearing surface periphery (222), such that the multi-material tube (400) slides longitudinally within the composite tube (100) with the insertion end (430). The multi-material tube (400) may reside within the composite tube (100) and the multi-material tube exterior surface (420) is in slideable contact with the bearing surface (220) substantially preventing the multi-material tube exterior surface (420) from damaging the composite tube interior surface (110); as may be seen in FIG. 2.

Figure 19:
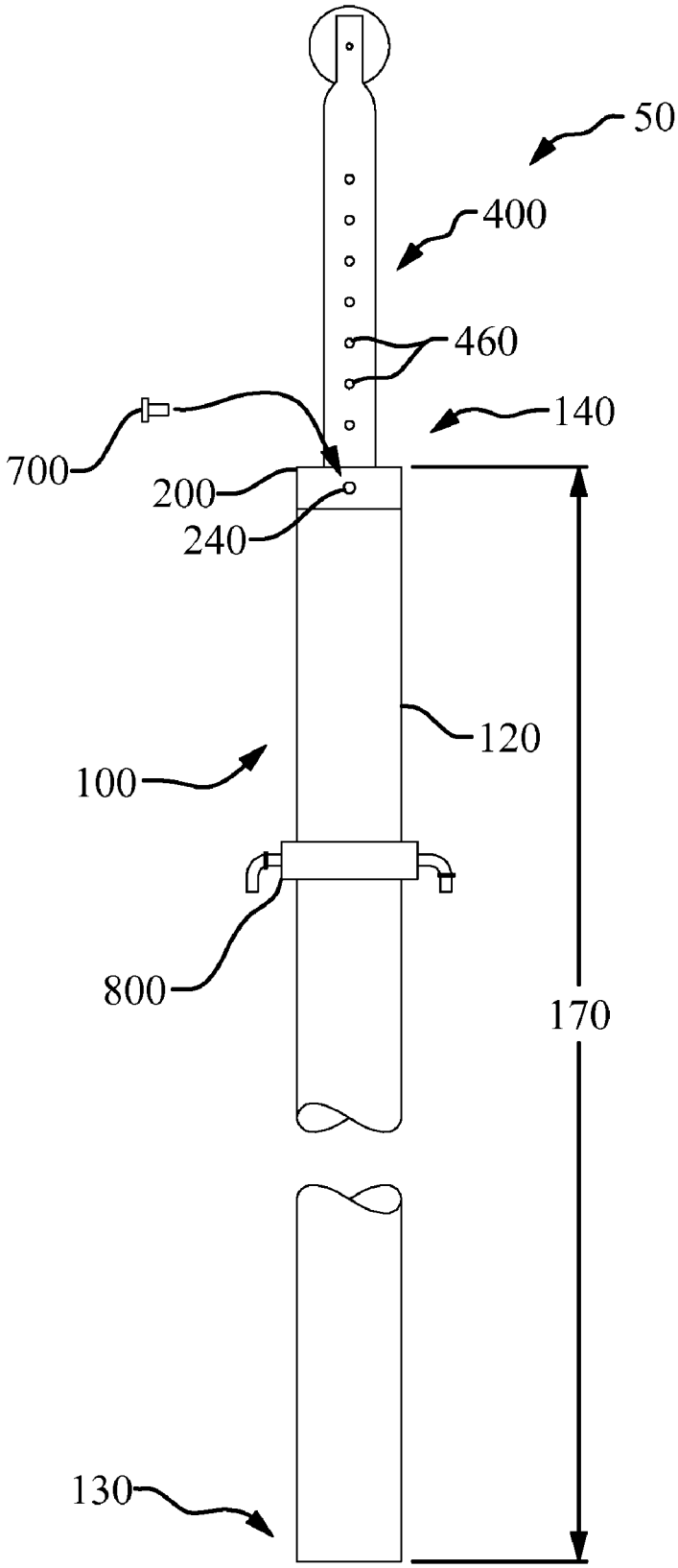
FIG. 19 is an elevation view of another embodiment of a composite locking upright, not to scale.

In some embodiments, there may be a locking tool (700), seen well at least in FIGS. 1 and 19, wherein the rope (22) is connected to the rope contact end (440) thereby releasably attaching the net (20) to the composite locking upright (50) and the net playing height (24) is set by sliding the multi-material tube (400) longitudinally within the composite tube (100). Operating the locking tool (700) in cooperation with both the locking tool receiver (240) and the net height receiving fixtures (460) to lock the multi-material tube (400) relative to the composite tube (100), thereby substantially preventing the multi-material tube (400) from moving longitudinally relative to the composite tube (100).

Figure 22:
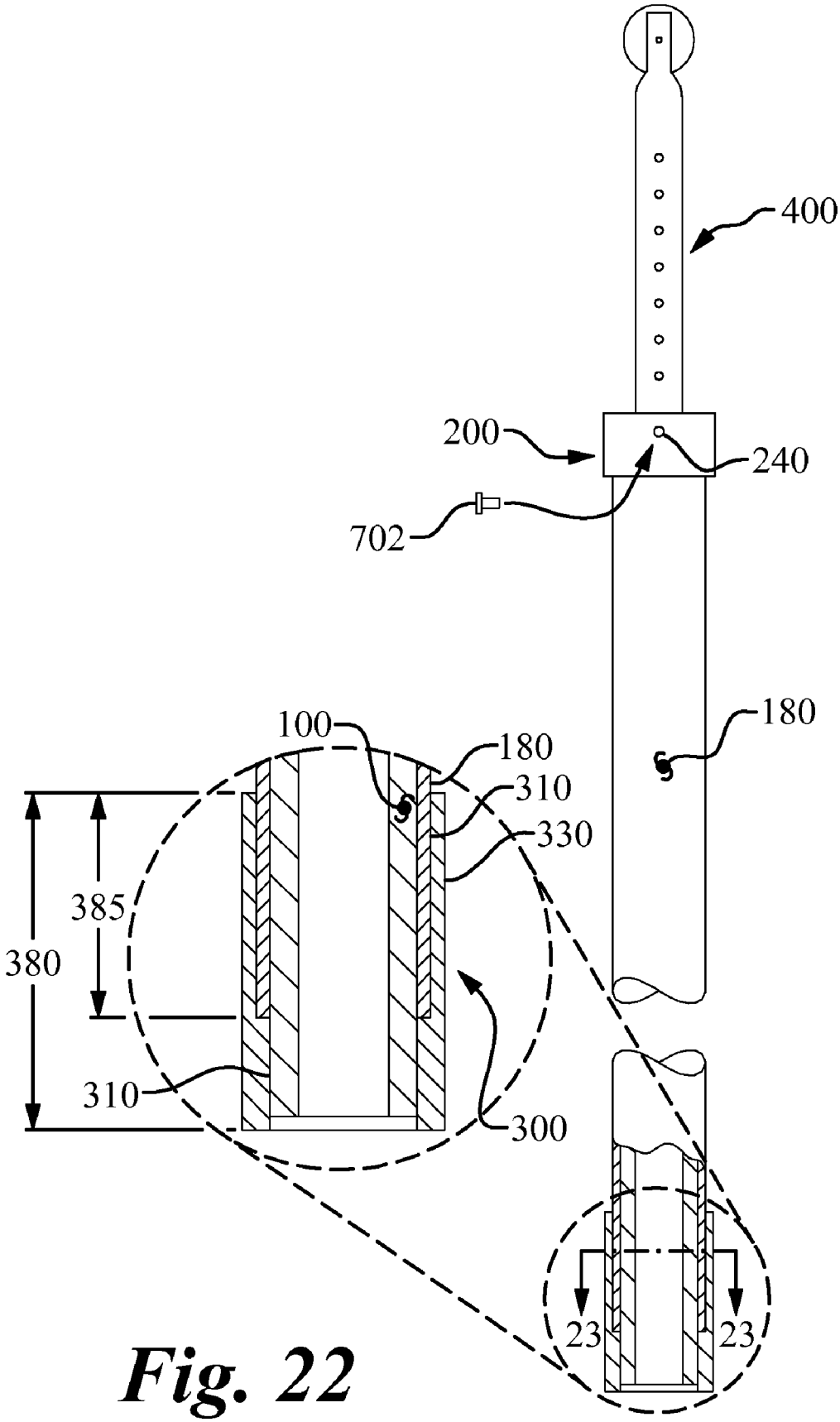
FIG. 22 is an elevation of another embodiment of a composite locking upright, in part in cross-sectional view, not to scale, with an enlarged insert illustration of part of the Figure.

In other embodiments, as seen in FIGS. 22 and 23, a decorative overlay (180) may be attached to at least a portion of the composite tube exterior surface (120). Such an overlay (180) provides a bright and colorful surface appearance to the upright (50), and may be used to feature any desired indicia, including but not limited to team logos and advertisements. The decorative overlay (180) may be attached circumferentially around the composite tube exterior periphery (122), and may be formed seamlessly, or with a seam.

In certain embodiments, again as seen in FIGS. 22 and 23, the lower protective collar (300) overlays at least a portion of the composite tube exterior surface (120) and a portion of the decorative overlay (180). Such a construction may allow a lowermost edge of the decorative overlay to be protected by a portion of the lower protective collar (300). Such construction may minimize peeling or other damage to the decorative overlay (180). In one embodiment, the lower protective collar (300) may overlap a portion of the decorative overlay (180) by a collar-overlay overlap height (385) greater than 1 cm, although one skilled in the art will see that other degree of overlay may be desirable. For similar protective reasons, the upper edge of the decorative overlay (180) may be at least partially covered by the upper protective collar (200).

In one embodiment, as seen in FIG. 20, the lower protective collar height (380) may be at least two centimeters more than the built-in sleeve depth (13), as seen in FIG. 1. Again, one skilled in the art may see that other relationships between the lower protective collar height (380) and the built-in sleeve depth (13) may be desirable.

In certain embodiments, as seen in FIG. 19, as would be known to one familiar with composite materials, it may be possible to form the composite tube (100) from a material that is sufficiently damage-resistant, so that it may be repeatedly engaged with the built-in sleeve (12) without damage, and therefore, without a lower protective collar (300). Other composites, such as carbon fiber composites, which may be desirable to use in some embodiments because of their light-weight and rigidity, may be susceptible to damage. As one skilled in the art would know, such carbon fiber composites are particularly vulnerable to splitting and fracture, especially in areas of abrasion or other damage, and from blows directed along unprotected end-grains of a carbon fiber tube. For this reason, it may be desirable to protect the composite tube (100) by having a lower protective collar (300), as seen in FIG. 20, which may include a metallic lower protective collar (300). Such a metallic lower protective collar (300), which may be quite thin and light in weight, nonetheless helps to protect the lower protective collar (300) from damage. In some embodiments, the lower collar maximal thickness (390) may be less than 5% of the composite tube maximal diameter (190), although, as seen in FIG. 21, it may be more.

The facilitate the engagement of the upper protective collar (200) and the multi-material tube (400), the upper protective collar bearing surface (220) may include a plastic upper protective collar bearing surface (220) to improve the slidable engagement.

In other embodiments, as seen in FIGS. 2 and 10, the composite tube (100) may further include a stop bar (150) with the multi-material tube (400) having a maximum extension (480) measured from the rope contact end (440) to the insertion end (430). Such a stop bar (150) may be positioned, again as seen in FIG. 2, on the composite tube interior surface (110) at a drop distance (160) from the guard surface (250) such that the drop distance (160) is less than the maximum extension (480). This substantially prevents the rope contact end (440) from contacting the guard surface (250) and may further prevent damage to the upright (50) in the case of an unintended and sudden drop of the multi-material tube (400) into the composite tube (100).

As a further protection against damage, the lower protective collar support end (340), as seen in FIG. 20, may include a lower protective collar base piece (345), either in tandem with, or without, the use of a lower protective collar (300). As another means of minimizing possible damage, as seen well in FIGS. 2 and 6, the multi-material tube (400) may be formed with a composite tube interior surface protective ring (450)

extending outwardly from the multi-material tube exterior surface (420). This may allow the composite tube interior surface protective ring (450) to slidably contact the composite tube interior surface (110) as the multi-material tube (400) translates longitudinally within the composite tube (100), providing both lateral support and decreasing possible material damage from the slidable contact.

In certain embodiments, as seen well in FIGS. 1, 2, 6, 19, 20, and 22, the composite locking upright (50) may further include a pulley wheel (470) rotatably attached to the rope contact end (440) of the multi-material tube (400). In other embodiments, such as is seen well in FIGS. 9 and 19, there may be a hook collar (800), having a hook collar height (810), attached to the composite tube (100) between the upper protective collar (200) and the sleeve support end (130). In other embodiments, not shown, hooks or other net attachment means may be provided on the upper protective collar (200). The hook collar height (810), in some embodiments, may be between approximately 1 and approximately 10 percent of the composite tube height (170) and the hook collar (800) may serve to secure the rope (22) thereby holding the net (20) in position.

One skilled in the art will realize that the overall height of the composite locking upright (50) may be regulated in many ways. In some embodiments, see in FIGS. 1, 10, 19, 20, and 22; the upper protective collar (200) has an upper collar exterior surface (230), and the locking tool receiver (240) may be formed with at least one locking recess (242) extending from the upper collar exterior surface (230) to the bearing surface (220). In certain of these embodiments, such as seen well in FIG. 10, the net height receiving fixtures (460) may be a plurality of pin recesses (462) extending from the multi-material tube exterior surface (420) to the multi-material tube interior surface (410) and the pin recesses (462) are spaced longitudinally along the multi-material tube (400). The locking tool (700) may be a pin (702), well seen in FIG. 20, in some embodiments, that cooperates with both the locking recess (242) and the pin recesses (462) such that the pin (702) together with both the locking recess (242) and the pin recesses (462) locks the multi-material tube (400) relative to the composite tube (100).

In certain embodiments, discussed only by way of illustration and not limitation, a pin or other object inserted into holes in a composite material may tend to damage the holes, leading to undesirable "rounding" of the holes and even as initiation points for lengthwise cracking or splitting of the composite. In such embodiments, it may be helpful for at least one of the at least one abrasion resistant sections (405) to be a metal inlay extending through the multi-material tube (400) a predetermined distance from the multi-material tube exterior surface (420) toward the multi-material tube interior surface (410). Such inlays may be envisioned from FIGS. 13-18, although by no means are the abrasion resistant sections (405) necessarily formed in any part of metal.

In certain embodiments where metallic or other non-composite abrasion resistant sections (405) are envisioned, they may comprise a minority of the mass of the multi-material tube (100), and in some embodiments, the multi-material tube (100) comprises at least 90% composite material by weight.

One skilled in the art will realize that any and all of the above variations and embodiments may be combined with many others, and the discussion of any element in association with any other element does not necessarily imply any form of limitation to such a combination.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations.

Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A composite locking upright (50) for installation into a playing surface (10) having a built-in sleeve (12) and a built-in sleeve depth (13), and following installation into the built-in sleeve (12), the upright (50) supports a net (20) having a rope (22) at a net playing height (24) by supporting, and securing, the rope (22), comprising:

(A) a composite tube (100) having a composite tube interior surface (110), a composite tube exterior surface (120), a sleeve support end (130), a receiving end (140), and a composite tube maximal diameter (190), wherein the composite tube interior surface (110) is defined by a composite tube interior periphery (112), the composite tube exterior surface (120) is defined by a composite tube exterior periphery (122), and a composite tube height (170) is measured from the sleeve support end (130) to the receiving end (140);

(B) an upper protective collar (200) having a bearing surface (220), a locking tool receiver (240), and a guard surface (250), wherein the bearing surface (220) is defined by a bearing surface periphery (222), and whereby the upper protective collar (200) is attached at the receiving end (140);

(C) a lower protective collar (300) having a lower collar attachment surface (310), a sleeve contact surface (330), a lower collar support end (340), a lower collar height (380), and at least one lower collar maximal thickness (390), wherein the lower collar attachment surface (310) cooperates with the composite tube (100) such that the lower protective collar (300) is attached at the sleeve support end (130), and the built-in sleeve (12) releasably receives the lower protective collar (300) thereby substantially preventing the built-in sleeve (12) from damaging the composite tube (100);

(D) a multi-material tube (400) having a multi-material tube interior surface (410), a multi-material tube exterior surface (420), at least one abrasion resistant section (405), an insertion end (430), and a rope contact end (440), wherein the multi-material tube exterior surface (420) is formed with a plurality of net height receiving fixtures (460) wherein at least one of the plurality of net height receiving fixtures (460) is at least partially set within at least one of the abrasion resistant sections (405), and the multi-material tube exterior surface (420) is defined by a multi-material tube exterior periphery (422) that cooperates with the bearing surface periphery (222), such that the multi-material tube (400) slides longitudinally within the composite tube (100) with the insertion end (430) of the multi-material tube (400) residing within the composite tube (100) and the multi-material tube exterior surface (420) is in slideable contact with the bearing surface (220) substantially preventing the multi-material tube exterior surface (420) from damaging the composite tube interior surface (110); and (E) a locking tool (700), wherein the rope (22) is connected to the rope contact end (440) thereby releasably attaching the net (20) to the composite locking upright (50) and the net playing height (24) is set by sliding the multi-material tube (400) longitudinally within the composite tube (100) and operating the locking tool (700) in cooperation with both the locking tool receiver (240) and the net height receiving fixtures (460) to lock the multi-material tube (400) relative to the composite tube (100) thereby substantially preventing the multi-material tube (400) from moving longitudinally relative to the composite tube (100).

2. The composite locking upright (50) of claim 1, wherein a decorative overlay (180) is attached to at least a portion of the composite tube exterior surface (120).

3. The composite locking upright (50) of claim 2, wherein the decorative overlay (180) is attached circumferentially around the composite tube exterior periphery (122).

4. The composite locking upright (50) of claim 2, wherein the lower protective collar (300) overlaps at least a portion of the composite tube exterior surface (120) and a portion of the decorative overlay (180).

5. The composite locking upright (50) of claim 1, wherein the lower collar height (380) is at least two centimeters more than the built-in sleeve depth (13).

6. The composite locking upright (50) of claim 4, wherein the lower protective collar (300) overlaps a portion of the decorative overlay (180) by a collar-overlay overlap height (385) greater than 1 cm.

7. The composite locking upright (50) of claim 1, wherein the lower protective collar (300) further comprises a metal.

8. The composite locking upright (50) of claim 1, wherein the bearing surface (220) further comprises a plastic.

9. The composite locking upright (50) of claim 1, wherein the composite tube (100) further includes a stop bar (150) and the multi-material tube (400) has a maximum extension (480) measured from the rope contact end (440) to the insertion end (430) wherein the stop bar (150) is positioned on the composite tube interior surface (110) at a drop distance (160) from the guard surface (250) such that the drop distance (160) is less than the maximum extension (480) thereby substantially preventing the rope contact end (440) from contacting the guard surface (250).

10. The composite locking upright (50) of claim 1, wherein the lower protective collar support end (340) further comprises a lower protective collar base piece (345).

11. The composite locking upright (50) of claim 1, further including a pulley wheel (470) rotatably attached to the rope contact end (440) of the multi-material tube (400).

12. The composite locking upright (50) of claim 1, wherein the multi-material tube (400) is formed with a composite tube interior surface protective ring (450) extending outwardly from the multi-material tube exterior surface (420) wherein the composite tube interior surface protective ring (450) slidably contacts the composite tube interior surface (110) as the multi-material tube (400) translates longitudinally within the composite tube (100).

13. The composite locking upright (50) of claim 1, further including a hook collar (800) having a hook collar height (810) attached to the composite tube (100) between the upper protective collar (200) and the sleeve support end (130).

14. The composite locking upright (50) of claim 1, wherein the upper protective collar (200) has an upper collar exterior surface (230), and wherein the locking tool receiver (240) is formed with at least one locking recess (242) extending from the upper collar exterior surface (230) to the bearing surface (220), the net height receiving fixtures (460) are a plurality of pin recesses (462) extending from the multi-material tube exterior surface (420) to the multi-material tube interior surface (410) and the pin recesses (462) are spaced longitudinally along the multi-material tube (400), and the locking tool (700) is a pin (702) that cooperates with both the locking recess (242) and the pin recesses (462) such that the pin (702) together with both the locking recess (242) and the pin recesses (462) locks the multi-material tube (400) relative to the composite tube (100).

15. The composite locking upright (50) of claim 1, further including a hook collar (800) having a hook collar height (810) attached to the composite tube (100) wherein the hook collar height (810) is between approximately 1 and approximately 10 percent of the composite tube height (170) and the hook collar (800) secures the rope (22) thereby holding the net (20) in position.

16. The composite locking upright (50) of claim 1, wherein the lower collar maximal thickness (390) is less than 5% of the composite tube maximal diameter (190).

17. The composite locking upright (50) of claim 1, wherein the multi-material tube (400) comprises at least 90% composite material by weight.

18. The composite locking upright (50) of claim 1, wherein at least one of the at least one abrasion resistant sections (405) is a metal inlay extending through the multi-material tube (400) a predetermined distance from the multi-material tube exterior surface (420) toward the multi-material tube interior surface (410).

19. A composite locking upright (50) for installation into a playing surface (10) having a built-in sleeve (12), and following installation into the built-in sleeve (12), the upright (50) supports a net (20) having a rope (22) at a net playing height (24) by supporting, and securing, the rope (22), comprising:

(A) a composite tube (100) having a composite tube interior surface (110), a composite tube exterior surface (120), a sleeve support end (130), and a receiving end (140), wherein the composite tube interior surface (110) is defined by a composite tube interior periphery (112), the composite tube exterior surface (120) is defined by a composite tube exterior periphery (122), and a composite tube height (170) is measured from the sleeve support end (130) to the receiving end (140);

(B) an upper protective collar (200) having a bearing surface (220), a locking tool receiver (240), and a guard surface (250), wherein the bearing surface (220) is defined by a bearing surface periphery (222), and whereby the upper protective collar (200) is attached at the receiving end (140);

(C) a lower protective collar (300) having a lower collar attachment surface (310), a sleeve contact surface (330), and a lower collar height (380), wherein the lower collar attachment surface (310) cooperates with the composite tube (100) such that the lower protective collar (300) is attached at the sleeve support end (130) and the lower protective collar (300) overlays at least a portion of the composite tube exterior surface (120), and the built-in sleeve (12) releasably receives the lower protective collar (300) thereby substantially preventing the built-in sleeve (12) from damaging the composite tube (100); and (D) a decorative overlay (180) attached to at least a portion of the composite tube exterior surface (120), wherein the lower protective collar (300) overlays at least a portion of the composite tube exterior surface (120) and a portion of the decorative overlay (180), and (E) a multi-material tube (400) having a multi-material tube interior surface (410), a multi-material tube exterior surface (420), at least one abrasion resistant section (405), an insertion end (430), and a rope contact end (440), wherein the multi-material tube exterior surface (420) is formed with a plurality of net height receiving fixtures (460) wherein at least one of the plurality of net height receiving fixtures (460) is at least partially set within at least one of the at least one abrasion resistant sections (405), and the multi-material tube exterior surface (420) is defined by a multi-material tube exterior periphery (422) that cooperates with the bearing surface periphery (222), such that the multi-material tube (400) slides longitudinally within the composite tube (100) with the insertion end (430) of the multi-material tube (400) residing within the composite tube (100) and the multi-material tube exterior surface (420) is in slideable contact with the bearing surface (220) substantially preventing the multi-material tube exterior surface (420) from damaging the composite tube interior surface (110); and (F) a locking tool (700), wherein the rope (22) is connected to the rope contact end (440) thereby releasably attaching the net (20) to the composite locking upright (50) and the net playing height (24) is set by sliding the multi-material tube (400) longitudinally within the composite tube (100) and operating the locking tool (700) in cooperation with both the locking tool receiver (240) and the net height receiving fixtures (460) to lock the multi-material tube (400) relative to the composite tube (100) thereby substantially preventing the multi-material tube (400) from moving longitudinally.

20. A composite locking upright (50) for installation into a playing surface (10) having a built-in sleeve (12), and following installation into the built-in sleeve (12), the upright (50) supports a net (20) having a rope (22) at a net playing height (24) by supporting, and securing, the rope (22), comprising:

(A) a composite tube (100) having a composite tube interior surface (110), a composite tube exterior surface (120), a sleeve support end (130), and a receiving end (140), wherein the composite tube interior surface (110) is defined by a composite tube interior periphery (112), the composite tube exterior surface (120) is defined by a composite tube exterior periphery (122), and a composite tube height (170) is measured from the sleeve support end (130) to the receiving end (140);

(B) an upper protective collar (200) having a bearing surface (220), a locking tool receiver (240), and a guard surface (250), wherein the bearing surface (220) is defined by a bearing surface periphery (222), and whereby the upper protective collar (200) is attached at the receiving end (140);

(C) a multi-material tube (400) having a multi-material tube interior surface (410), a multi-material tube exterior surface (420), at least one abrasion resistant section (405), an insertion end (430), and a rope contact end (440), wherein the multi-material tube exterior surface (420) is formed with a plurality of net height receiving fixtures (460) wherein at least one of the plurality of net height receiving fixtures (460) is at least partially set within at least one of the at least one abrasion resistant sections (405), and the multi-material tube exterior surface (420) is defined by a multi-material tube exterior periphery (422) that cooperates with the bearing surface periphery (222), such that the multi-material tube (400) slides longitudinally within the composite tube (100) with the insertion end (430) of the multi-material tube (400) residing within the composite tube (100) and the multi-material tube exterior surface (420) is in slideable contact with the bearing surface (220) substantially preventing the multi-material tube exterior surface (420) from damaging the composite tube interior surface (110); and (D) a locking tool (700), wherein the rope (22) is connected to the rope contact end (440) thereby releasably attaching the net (20) to the composite locking upright (50) and the net playing height (24) is set by sliding the multi-material tube (400) longitudinally within the composite tube (100) and operating the locking tool (700) in cooperation with both the locking tool receiver (240) and the net height receiving fixtures (460) to lock the multi-material tube (400) relative to the composite tube (100) thereby substantially preventing the multi-material tube (400) from moving longitudinally relative to the composite tube (100).

* * * * *